US010558151B2

(12) United States Patent
Hirota et al.

(10) Patent No.: US 10,558,151 B2
(45) Date of Patent: Feb. 11, 2020

(54) IMAGE FORMING APPARATUS AND FIXING DEVICE

(71) Applicant: CANON KABUSHIKI KAISHA, Tokyo (JP)

(72) Inventors: Yusuke Hirota, Ebina (JP); Munehito Kurata, Suntou-gun (JP); Ryo Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/134,740

(22) Filed: Sep. 18, 2018

(65) Prior Publication Data

US 2019/0086844 A1 Mar. 21, 2019

(30) Foreign Application Priority Data

Sep. 21, 2017 (JP) ..... 2017-181188

(51) Int. Cl.
*G03G 15/20* (2006.01)
*G03G 15/16* (2006.01)

(52) U.S. Cl.
CPC ..... *G03G 15/2028* (2013.01); *G03G 15/16* (2013.01); *G03G 15/2053* (2013.01); *G03G 15/2064* (2013.01)

(58) Field of Classification Search
CPC ..... G03G 15/16; G03G 15/2028; G03G 15/2053; G03G 15/2064
See application file for complete search history.

(56) References Cited

U.S. PATENT DOCUMENTS

| | | | | |
|---|---|---|---|---|
| 6,643,476 | B1 * | 11/2003 | Kinouchi | G03G 15/2042 219/619 |
| 2006/0269307 | A1 * | 11/2006 | Funabiki | G03G 15/2046 399/45 |
| 2007/0059010 | A1 * | 3/2007 | Arimoto | G03G 15/2017 399/69 |
| 2009/0297204 | A1 * | 12/2009 | Kaji | G03G 15/2017 399/92 |
| 2013/0279932 | A1 * | 10/2013 | Ishigai | G03G 15/2039 399/69 |
| 2014/0286665 | A1 * | 9/2014 | Minagawa | G03G 15/2017 399/69 |
| 2018/0059590 | A1 * | 3/2018 | Suzuki | G03G 15/2042 |

FOREIGN PATENT DOCUMENTS

| | | | |
|---|---|---|---|
| JP | 2002-287564 | A | 10/2002 |
| JP | 2007-206510 | A | 8/2007 |
| JP | 2009-288275 | A | 12/2009 |
| JP | 2014-145895 | A | 8/2014 |
| JP | 2015-036743 | A | 2/2015 |

* cited by examiner

*Primary Examiner* — Ryan D Walsh
(74) *Attorney, Agent, or Firm* — Canon U.S.A. Inc., IP Division

(57) ABSTRACT

The present disclosure relates to an image forming apparatus that forms toner images on a recording material. A control unit is configured to set, when performing fixing processing to fix a toner image onto the recording material, a first mode where thermal generation distribution of the heater is switched in accordance with electric power supply to the heater, a second mode where thermal generation distribution of the heater is switched in accordance with the electric power supply to the heater and temperature at the non-sheet-passing portion, and a third mode where the blower unit is driven in accordance with temperature at the non-sheet-passing portion.

20 Claims, 13 Drawing Sheets

IMAGE FORMING APPARATUS AND FIXING DEVICE

BACKGROUND OF THE INVENTION

Field of the Invention

The present disclosure generally relates to image forming and specifically, relates to image forming apparatuses where images are formed by recording methods such as electrophotography and electrostatic recording.

Description of the Related Art

A fixing method for fixing unfixed toner images onto recording material that image forming apparatuses such as printers and copiers using the electrophotographic system generally use is thermal fixing, where an unfixed toner image is subjected to heat, so as to be fused onto the recording material. In recent years, fixing devices using a film-heating system have come into practical use, from the perspective of quick-starting and energy conservation.

Fixing devices that use the film-heating system form a fixing nip portion by placing a heat resistant film (fixing film) between a ceramic heater serving as a heating member, and a pressing roller serving as a pressing member. A recording material on which an unfixed toner image has been formed and borne is introduced between the fixing film and pressing roller at the fixing nip portion, so as to be pinched and conveyed along with the fixing film. Accordingly, the unfixed toner image is fixed on the face of the recording material by the pressure of the fixing nip portion, while applying the heat of the ceramic heater across the fixing film.

There is a condition known in fixing devices that use the film-heating system where, when small recording material (small-sized sheets, narrow sheets) that are smaller than recording material having a maximum sheet-passing width in the width direction orthogonal to the recording material conveyance direction (maximum size sheets) are consecutively passed, the temperature rises at non-sheet-passing portions where sheets are not passing. When passing maximum size sheets and performing fixing, the temperature distribution on the fixing film and pressing roller is generally uniform over the entire fixing region. However, when consecutively passing small-sized sheets and performing fixing, the temperature on the fixing film and pressing roller rises excessively at portions where sheets are not passing. The reason is that when small-sized sheets are consecutively passed, the heat quantity is not removed by the recording member at non-sheet-passing portions, and heat is locally accumulated at those portions.

When temperature rises at portions where sheets are not passing due to small-sized sheets being consecutively passed, and larger size sheets including the maximum size sheets pass in the next job, the toner excessively melts and a portion thereof remains on the fixing film, which is fixed on the recording material one cycle later. This causes an image defect called temperature offset. If there are temperature variations in the longitudinal direction in the non-sheet-passing portions, the image will exhibit uneven gloss. Further, there is a need to effect control where temperature at the non-sheet-passing portions is suppressed by increasing intervals between sheets and reducing productivity.

Temperature rising at non-sheet-passing portions increases as the heat quantity being removed by the recording material increases. Examples of such conditions include cases where the number of sheets processed per unit time (productivity) is great, the grammage of the recording material is great (thick paper), and so forth. A configuration is known to counter such temperature rising at non-sheet-passing portions by providing the heater serving as a heating member with resistor heating elements that generate different amounts of heat in the longitudinal direction, and changing the electric power application ratio, i.e., on duty ratio (Japanese Patent Laid-Open No. 2007-206510). A configuration where the edge portions that have become hot are cooled by directly blowing air thereupon with a fan has also been proposed (Japanese Patent Laid-Open No. 2002-287564), With regard to cooling, an image forming apparatus is known that performs cooling when temperature rises at non-sheet-passing portions due to printing in great numbers. That is to say, there is an image forming apparatus that suppresses rise of temperature at non-sheet-passing portions by detecting temperature by a temperature detection sensor installed near these portions, and when the temperature exceeds a threshold value set beforehand, the portions of which the temperature has risen are cooled by directly blowing air thereupon by a fan.

Further, recent improvement in productivity of image forming apparatus has made the condition of temperature rising at non-sheet-passing portions even more serious. There is also known an image forming apparatus that has both of the above-described configuration with resistor heating elements that generate different amounts of heat in the longitudinal direction of the heater, and the configuration where the non-sheet-passing portions of which the temperature has risen are cooled by directly blowing air thereupon by a fan, as a measure to handle this condition.

The above-described image forming apparatus that has both the resistor heating elements that generate different amounts of heat in the longitudinal direction of the heater, and the fan that cools the ends of the non-sheet-passing portions of which the temperature has risen has been able to handle rising in temperature at non-sheet-passing portions conventionally. However, recent improvement in productivity of image forming apparatus has made temperature rising at non-sheet-passing portions even more serious, and situations are occurring that conventional configurations are not able to sufficiently handle.

Also, change in power application ratio has not been performed to the allowable limit in conventional configurations, so a great amount of electric power has been consumed for heating and cooling at the portions where temperature rises. Particularly, high-productivity image forming apparatuses have a greater number of sheets passing per unit time, so the electric power consumption at the fixing device increases, and the temperature at the non-sheet-passing portions increases accordingly. This necessitates an increased amount of air being blown by the fan, and as a result, the fan also consumes more electric power. This situation where a great amount of electric power is being consumed by both heating and cooling should be avoided.

It has been found desirable to provide an image forming apparatus and fixing device where reduction in electric power consumption is realized by performing efficient temperature control at non-sheet-passing portions, capable of adapting to high-productivity demands as well.

SUMMARY OF THE INVENTION

An image forming apparatus includes: an image forming unit configured to form a toner image on a recording material; a fixing unit configured to fix the toner image formed on the recording material onto the recording material, the fixing unit including a rotation member, an opposing member configured to form a fixing nip portion along with the rotation member to pinch and convey the recording material, and a heater configured to change thermal generation distribution in a direction orthogonal to a conveyance direction of the recording material; a blower unit configured to suppress rise in temperature at a non-sheet-passing portion in the fixing unit where the recording material does not pass, the blower unit blowing air on at least one of the rotation member and the opposing member; and a control unit. The control unit is configured to set, when performing fixing processing to fix a toner image onto the recording material, a first mode where thermal generation distribution of the heater is switched in accordance with electric power supply to the heater, a second mode where thermal generation distribution of the heater is switched in accordance with the electric power supply to the heater and temperature at the non-sheet-passing portion, and a third mode where the blower unit is driven in accordance with temperature at the non-sheet-passing portion.

Further features of the present disclosure will become apparent from the following description of exemplary embodiments with reference to the attached drawings.

DESCRIPTION OF THE EMBODIMENTS

Embodiments of the present disclosure will be described below in detail with reference to the attached drawings.

First Embodiment

Image Forming Apparatus

Figure 1:
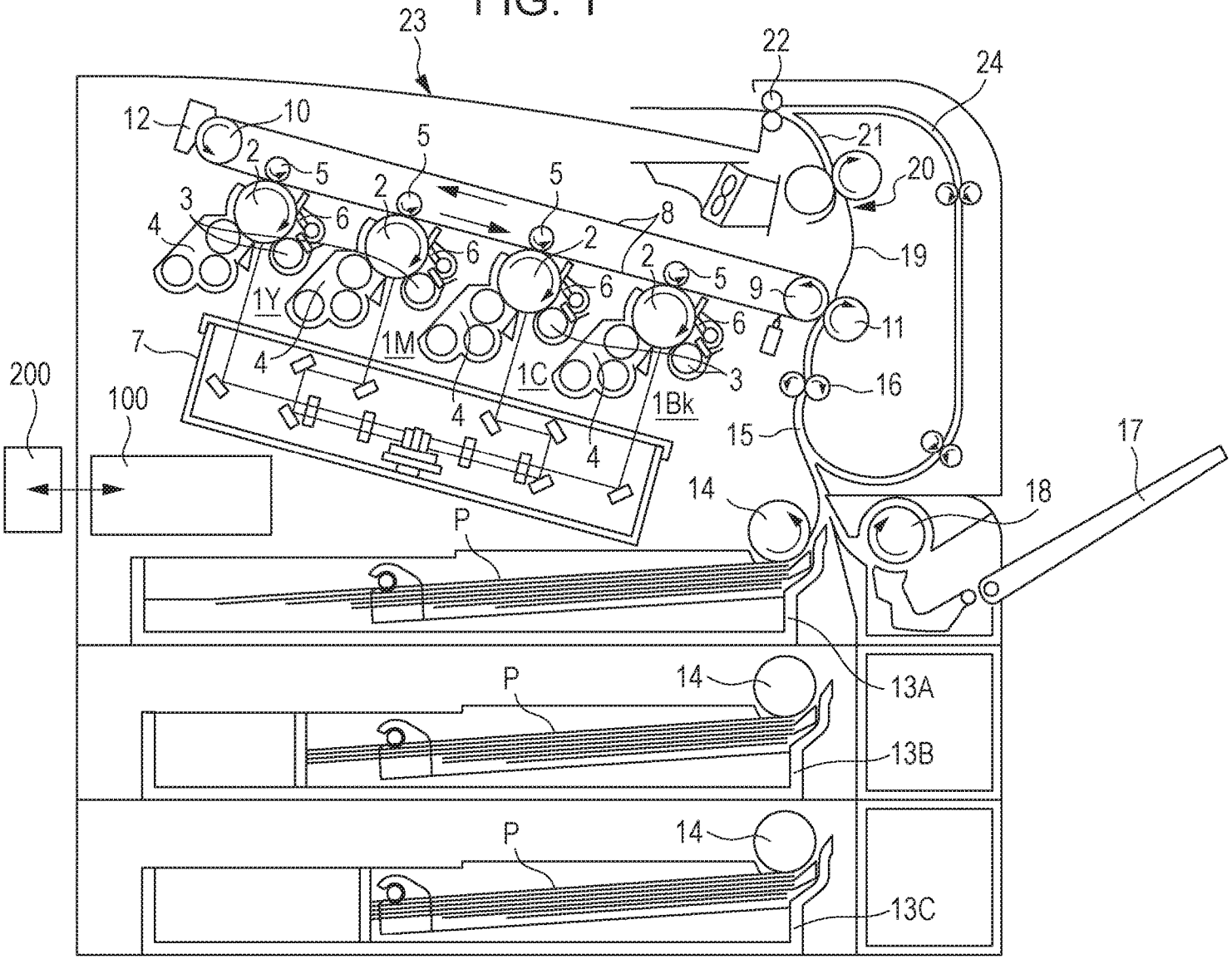
FIG. 1 is a schematic cross-sectional view of an image forming apparatus including a fixing device according to a first embodiment of the present disclosure.

FIG. 1 is a model diagram of the overall configuration of an example of an image forming apparatus including a fixing device according to a first embodiment of the present disclosure. This image forming apparatus can operate to form images in accordance with image information input from an external host device 200 that is communicably connected to a control circuit unit (control unit) 100 to form full-color images on recording material and output. The external host device 200 is a computer, image reader, or the like. The control unit 100 exchanges signals with the external host device 200. The control unit 100 also exchanges signals with various image forming devices, and governs image-formation sequence control.

An endless flexible intermediate transfer belt (hereinafter, simply "belt") 8 is stretched over a secondary transfer opposing roller 9 and a tension roller 10, and is rotationally driven at a predetermined speed in the counter-clockwise direction indicated by the arrows, by being driven by the secondary transfer opposing roller 9. A secondary transfer roller 11 is pressed against the secondary transfer opposing roller 9 across the belt 8. The contact portion of the belt 8 and the secondary transfer roller 11 is a secondary transfer portion.

First through fourth image forming units 1Y, 1M, 1C, and 1Bk, that form latent images by exposing respective image bearing members, develop the latent images using developing agent, and transfer images onto recording material, are arrayed in a single row at the lower side of the belt 8, with predetermined intervals therebetween in the direction of movement of the belt 8. Each image forming unit is a laser-exposure electrophotographic process mechanism, having a drum-shaped electrophotographic photosensitive member (hereinafter, simply "drum") 2 serving as an image bearing member rotationally driven in the clockwise direction indicated by the arrows, at a predetermined speed.

A primary charger 3, developing device 4, transfer roller 5 serving as a transfer unit, and drum cleaner device 6 are disposed around each drum 2. Each transfer roller 5 is disposed on the inner side of the belt 8, and press against the corresponding drum 2 across the belt 8. The contact portions of the drums 2 and the belt 8 are primary transfer portions. A laser exposing device 7 is provided for the drum 2 in each image forming unit, and is made up of a laser-emitting unit that emits light in accordance with time-sequential electric digital pixel signals in image information provided thereto, a polygon mirror, a reflecting mirror, and so forth.

The control circuit unit 100 causes the image forming units to perform image forming operations based on color-separated image signals input from the external host device 200. Accordingly, the first through fourth image forming units 1Y, 1M, 1C, and 1Bk form toner images of the colors yellow, magenta, cyan, and black, at predetermined control timings, on the faces of the rotating drums 2. The electrophotographic principle and process for forming toner images on the drums 2 is well-known, and accordingly description will be omitted here.

The toner images formed on the faces of the drums 2 of the image forming units are sequentially superimposed and transferred onto the outer face of the belt 8 that is rotationally driven in the forward direction of rotation of the drums 2 and at a speed corresponding to the rotation speed of the drums. Accordingly, an unfixed full-color image is formed by compositing, by overlaying the four toner images on the face of the belt 8.

Recording material (sheets) P of various sizes are accommodated by stacking in cassette feed units 13A, 13B, and 13C, that are vertically arrayed in tiers. At a predetermined feed timing, a feed roller 14 of a selected tier is driven. Accordingly, one sheet of the recording material P stored by stacking in the feed cassette of that tier is separated and fed, passes through a longitudinal conveyance path 15 and is conveyed to a registration roller 16. A feed roller 18 is driven when manual feed is selected. Accordingly, one sheet of recording material P set by stacking on a manual feed tray (multipurpose tray) 17 is separated and fed, passes through the longitudinal conveyance path 15 and is conveyed to the registration roller 16. The conveyance speed of the recording material P at this time is 200 min/s.

The registration roller 16 conveys the recording material P at a timing such that the leading edge of the recording material P reaches the secondary transfer portion at the timing of the leading edge of the full-color toner image on the rotating belt 8 reaches the secondary transfer portion. Accordingly, the full-color toner image on the belt 8 is collectively transferred onto the face of the recording material P by secondary transfer. The recording material P that has left the secondary transfer portion is separated from the face of the belt 8, and guided by a longitudinal guide 19 into a fixing device (fixing unit) 20.

This fixing device 20 fuses and blends the toner image of multiple colors, so as to be fixed on the face of the recording material P as a fixed image. The recording material P that has executed the fixing device 20 is a full-color image-formed article, that passes through a conveyance path 21 and discharged to a discharge tray 23 by a discharge roller 22. The face of the belt 8 after the recording material P having been separated therefrom at the secondary transfer portion is cleaned by a belt cleaning device 12, so that residual adhering matter such as secondary-transfer residual toner and so forth is removed, and the belt 8 is used for image formation repeatedly.

Fixing Device

Next, the fixing device 20 serving as an image heating device installed in the image forming unit according to the present embodiment will be described. Note that in the following description, the term "longitudinal direction" regarding the fixing device 20 and fixing members in the fixing device 20 refers to a direction parallel to a direction orthogonal to the direction of conveyance of the recording material in a plane of a recording material conveyance path. The term "front" regarding the fixing device is the face from which the recording material is guided in, and "left" and "right" refer to the left and right sides as viewed from the front of the device. The term "width of recording material" is the dimension of the recording material in the direction orthogonal to the recording material conveyance direction in the plane of the recording material (longitudinal direction of the fixing member).

Figure 2:
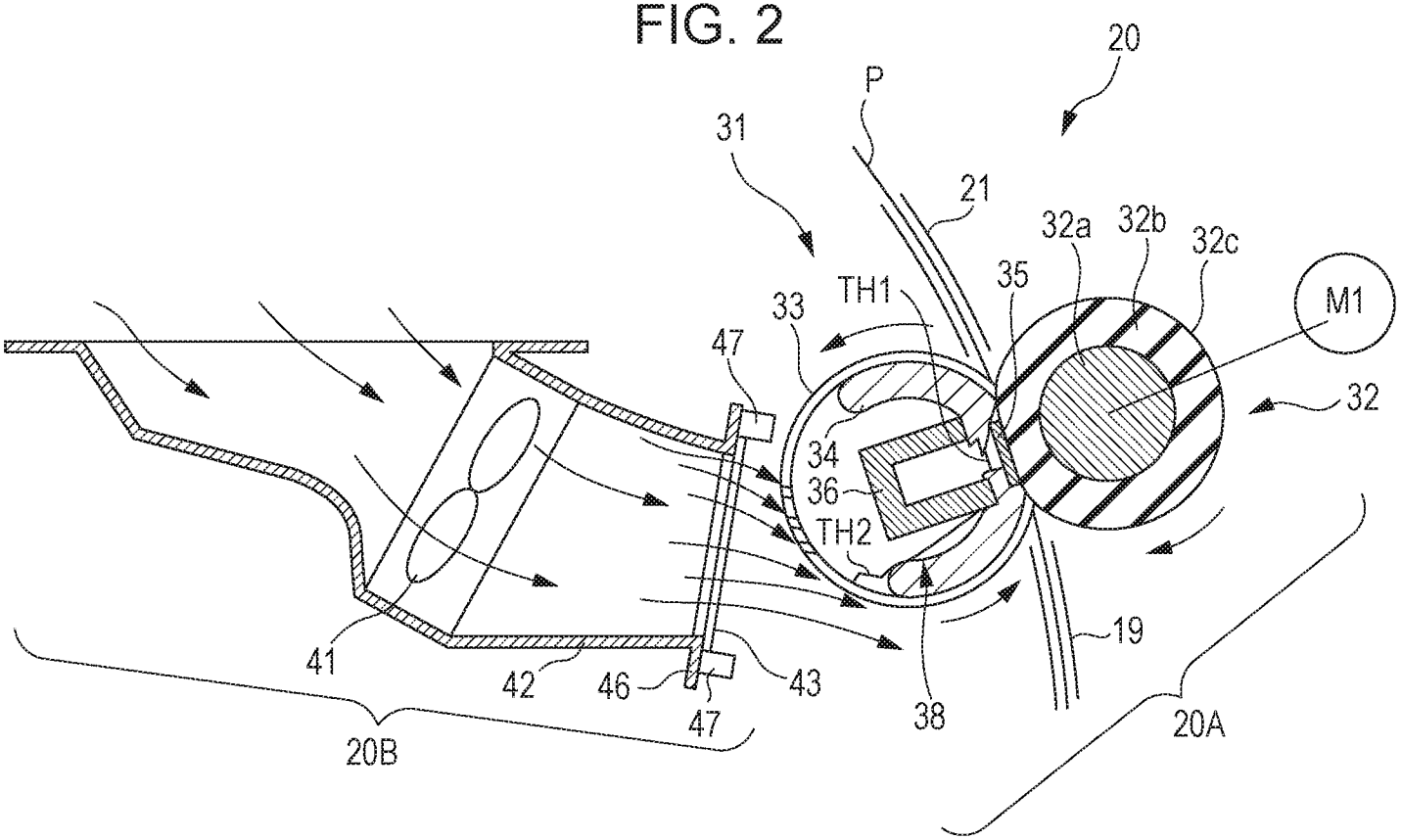
FIG. 2 is a schematic cross-sectional view of the fixing device according to the first embodiment.
Figure 3:
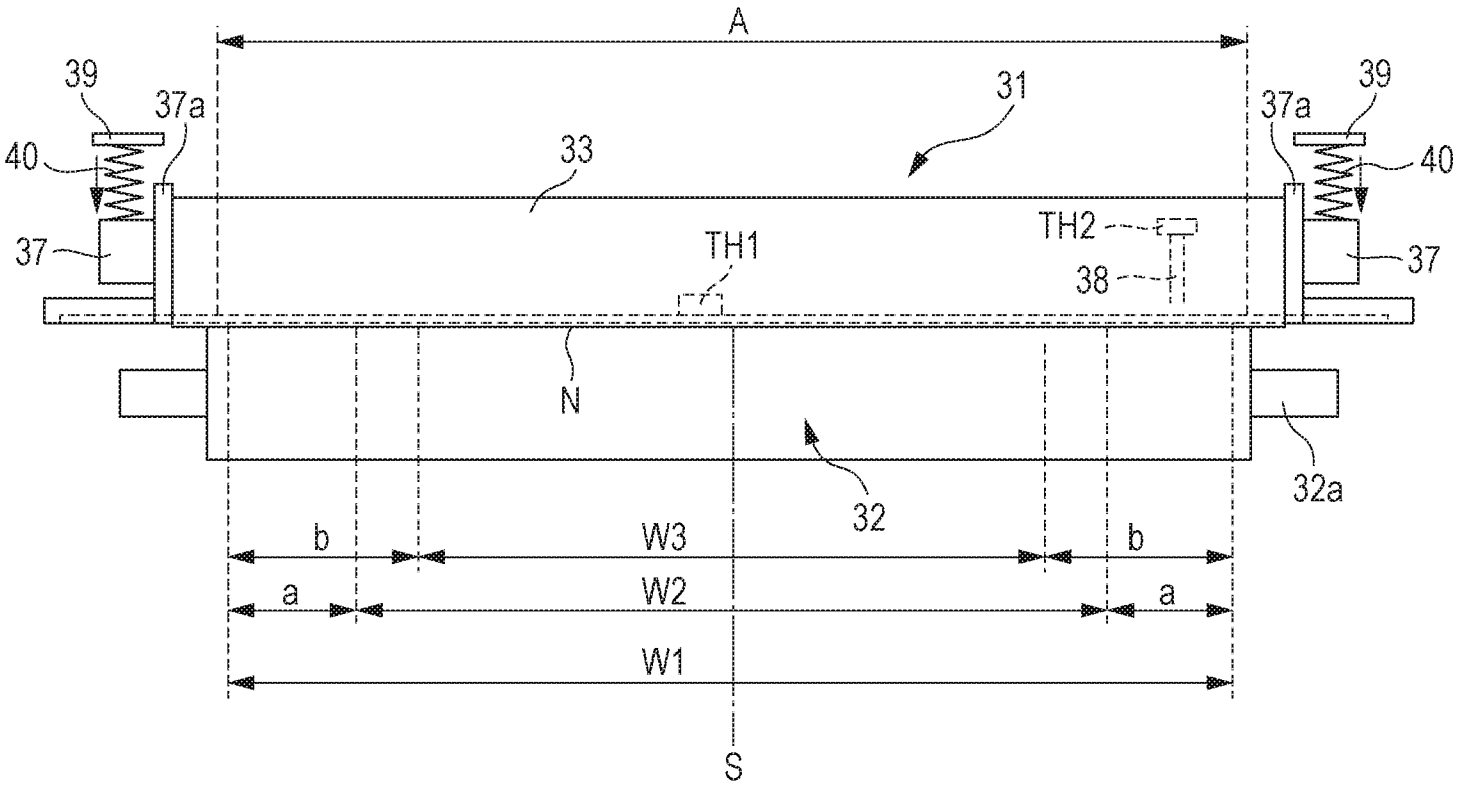
FIG. 3 is a schematic frontal view of the fixing mechanism.
Figure 4:
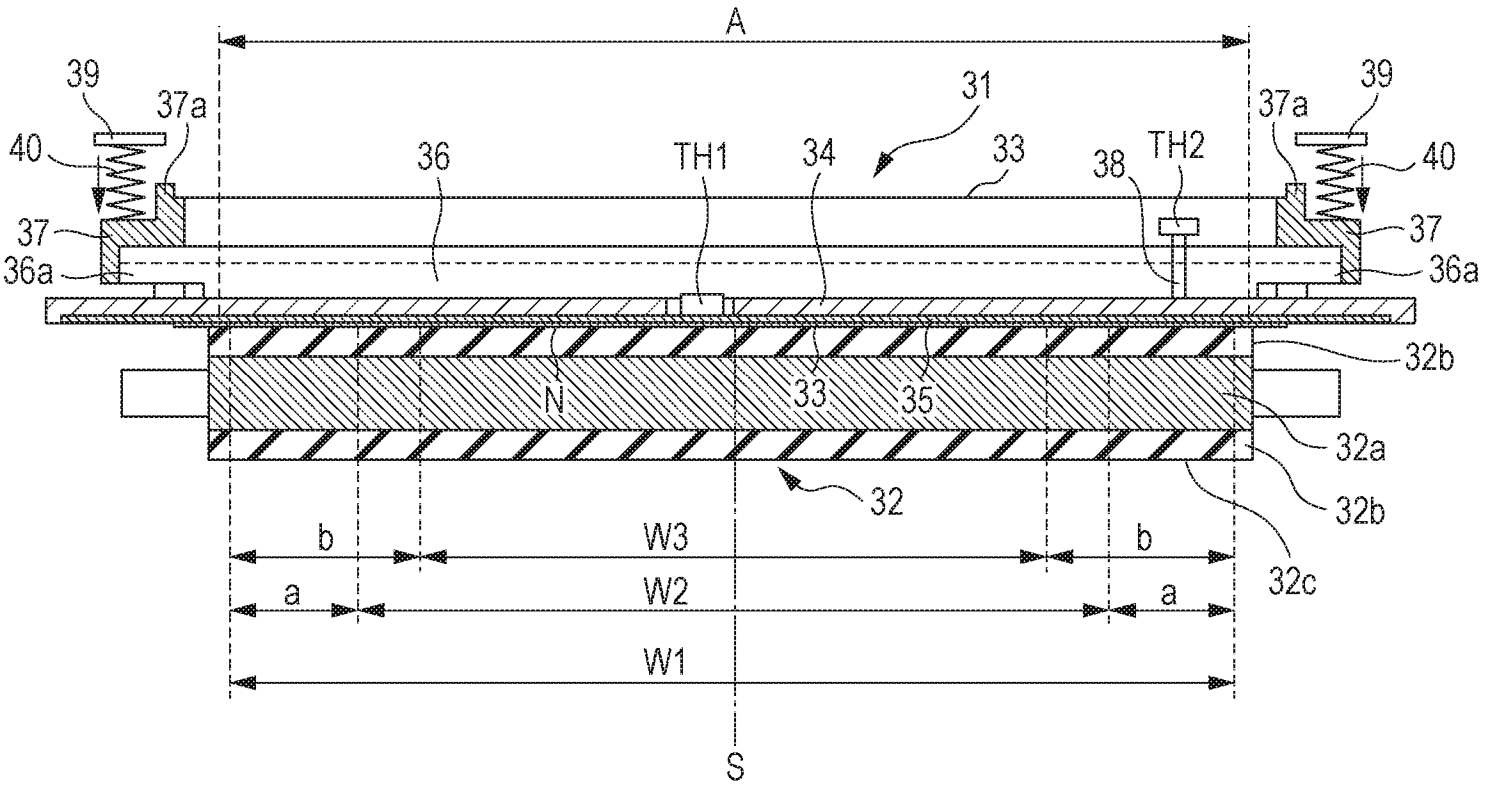
FIG. 4 is a schematic longitudinal-section frontal view of the fixing mechanism.

FIG. 2 is a schematic cross-sectional view illustrating the general configuration of the fixing device 20. The configuration of the fixing device 20 can be roughly broken down into a film (belt) heating type fixing mechanism unit 20A and a blower cooling mechanism unit 20B. FIG. 3 is a schematic frontal view of the fixing mechanism unit 20A, and FIG. 4 is a schematic longitudinal-section view thereof.

Fixing Mechanism Unit

The fixing mechanism unit 20A will be described with reference to FIGS. 2 through 4. The fixing mechanism unit 20A illustrated in FIG. 2 is a film heating type, pressing rotation member driving type (tensionless type) driving device. A fixing nip portion that is a sheet-passing nip (hereinafter, "nip portion") is formed by pressing by both of a film unit 31 serving as a first fixing member (heating member) and an elastic pressing roller 32 serving as a second fixing member (pressing member) serving as an opposing member opposing the film unit 31. The recording material P bearing the toner image is conveyed by pinching to the nip portion, and the toner image is heated, thereby obtaining a fixed image.

The film unit 31 has a fixing film 33 that is a cylindrical flexible endless belt serving as an image heating member, and a heat-resistant and rigid film guide member (hereinafter, "guide member") 34 of which the cross-sectional shape is a general halfpipe shape. The heat source is a ceramic heater (hereinafter, "heater") 35, which is fit into and fixed to a groove portion provided in the longitudinal direction of the outer face of the guide member 34. The film 33 is externally fit to the guide member 34 to which the heater 35 has been fit, with sufficient leeway. A rigid pressure stay (hereinafter "stay") 36 that has a cross-sectional shape of a box with one side open, is disposed on the inner side of the guide member 34.

The pressing roller 32 that rotates in contact with the outer peripheral face of the film 33 serving as a flexible belt member is formed by providing an elastic layer 32*b* of silicon rubber or the like on a metal core 32*a* to reduce hardness. A fluororesin layer 32*c* may further be provided on the outer perimeter, to improve surface properties. Examples include polytetrafluoroethylene (PTFE), PFA (a tetrafluoroethylene/perfluoroalkyl vinyl ether copolymer), fluorinated ethylene propylene (FEP, a tetrafluoroethylene-hexafluoropropylene copolymer resin), and so forth.

In FIG. 3, end portion holders 37 are each fit into outward-protruding arm portions 36*a* at both right and left end portions in the longitudinal direction of the stay 36. Flange portions 37*a* are integrally formed with the end portion holder 37. These function as back-up members that come into contact with the inner peripheral face of the film 33 serving as the flexible belt member. The pressing roller 32 serves as a pressing rotation member, disposed with both end portions of the metal core 32*a* rotatably borne by bearing members between right and left side plates of a device chassis (omitted from illustration).

The film unit 31 is arrayed in parallel to the pressing roller 32 facing the heater 35. Pressing springs 40 are compressed between the end portion holders 37 at the right and left sides and fixed spring holding members 39 at the right and left sides, as illustrated in FIGS. 3 and 4. Accordingly, the stay 36, guide member 34, and heater 35 are biased by pressing toward the side of the pressing roller 32.

This pressing-biasing force is set to a predetermined value, and the heater 35 is brought into contact with the pressing roller 32 against the elasticity of the elastic layer 32*b*, with the film 33 interposed therebetween, thereby forming a nip portion N of a predetermined width in the recording material conveyance direction between the film 33 and pressing roller 32. TH1 and TH2 each denote temperature sensors, with TH1 coming into contact with the heater 35 and TH2 coming into contact with the film 33 by a support member 38.

Figure 5:
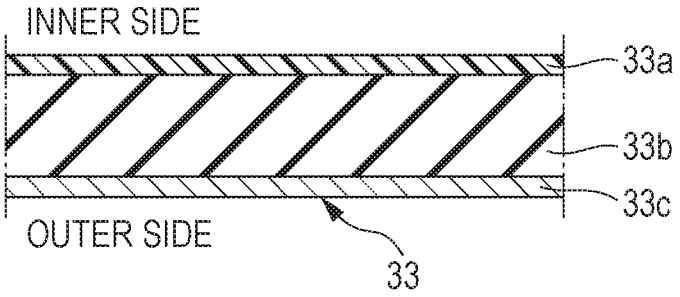
FIG. 5 is a model diagram illustrating a layer configuration of a fixing film.

The film 33 according to the present embodiment has a three-layer combined structure of a base layer 33*a*, elastic layer 33*b*, and release layer 33*c*, in that order from the inner face side toward the outer face side, as illustrated in the schematic layer configuration diagram in FIG. 5. A heat-resistant film having a thickness of 100 μm or less, and preferably is 50 μm or less but 20 μm or more, can be used for the base layer 33*a*, to reduce thermal capacity and improve quick starting. Examples of films that can be used include polyimide, polyimide amide, polyether ether ketone (PEEK), polyether sulfone (PES), polyphenylene sulfide, PTFE, PFA, FEP, and so forth. A metal sleeve of stainless steel nickel, may be used. A cylindrical stainless-steel sleeve 30 mm in diameter was used with the present embodiment. Silicon rubber having a rubber hardness of 10 as measured by a JIS-A durometer, thermal conductivity of 1.0 W/m·K, formed to a thickness of 300 μm, was used for the elastic layer 33*b*. A 30 μm thick PFA tube was used for the release layer 33*c*.

Figure 6:
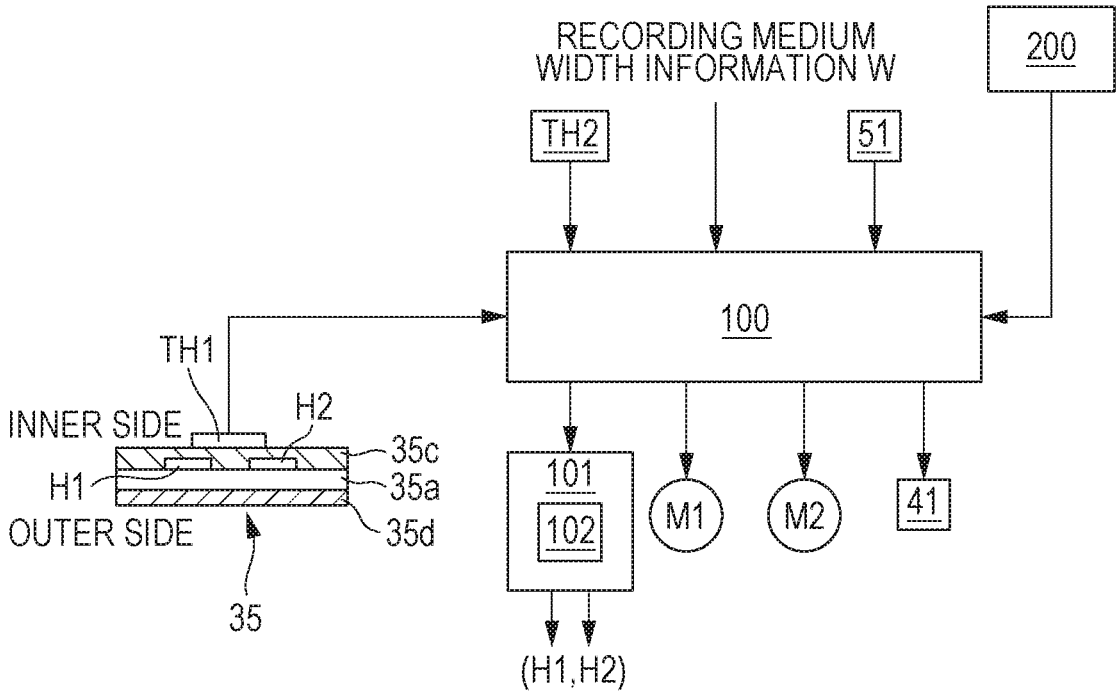
FIG. 6 is a schematic cross-sectional view of a heater and a block diagram of a control system.

FIG. 6 is a schematic cross-sectional view and control system diagram of the heater 35. The heater 35 according to the present embodiment is a back-surface heating type (a shape where the heating element is on the opposite face of the substrate as to the face that comes into the sleeve), using alumina or aluminum nitride or the like as the heater substrate. The heater 35 is a slender low-thermal-capacity linear heating member of which the longitudinal direction is the orthogonal direction to the direction of moment of the film 33 and recording material P.

As illustrated in FIG. 6, the heater 35 has a heater substrate 35*a* formed of alumina or aluminum nitride or the like. In the present embodiment, aluminum nitride was used for the heater substrate 35*a*. The heater substrate 35*a* has, on the rear face side (the opposite side from the side facing the fixing film), later-described heat-generating elements H1 and H2, provided by coating an electric resistance material such as silver-palladium (Ag/Pd) or the like, for example, in the longitudinal direction, to a thickness of approximately 10 μm and a width of 1 to 5 mm, by screen printing or the like. A protective layer 35*c* is further provided thereupon, formed of glass, fluororesin, or the like.

A sliding member (lubrication member) 35*d* is provided on the front face side (film-facing side) of the heater substrate 35*a* in the present embodiment. The heater 35 is inserted into and fixed in a groove formed following the longitudinal direction of the guide member 34 at the generally middle portion of the outer face thereof, with the rear side of the heater substrate where the sliding member 35*d* has been provided exposed. The face of the sliding member 35*d* of the heater 35 and the inner face of the film 33 come into sliding contact with each other at the nip portion. The film 33 that is a rotating image heating member is heated by the heater 35.

Electricity is applied between the ends of the heating elements H1 and H2 of the heater 35 in the longitudinal direction, whereby the heating elements H1 and H2 generate heat and the temperature of the heater 35 rapidly rises over the entire region of the heat generating portion in the longitudinal direction. The heating elements H1 and H2 each have different heat generating distributions in the longitudinal direction, and the electricity application ratio (on duty ratio) can be changed, in order to deal with temperature rising at non-sheet-passing portions, which will be described later in detail.

The temperature that has been generated by the heater is detected by the first temperature sensor (first temperature detecting unit, middle portion temperature sensor) TH1, which is a thermistor or the like disposed in contact with the outer face of the protective layer 35*c*. The output thereof (signal values relating to temperature) is input to the control circuit unit 100 (FIG. 6) via an A/D converter.

The control circuit unit 100 independently controls the electricity applied to the heating elements H1 and H2 from a power source (electric power supply unit, heading driving circuit unit) 101 to maintain the heater temperature to a predetermined temperature, based on detected temperature information input thereto. Thus, the temperature of the film 33 that is the image heating member heated by the heater 35 is controlled to a predetermined fixing temperature in accordance with the output of the first temperature sensor TH1.

At this time, the electric power applied to each of the heating elements H1 and H2 (power consumption) is directly obtained by a power meter 102 provided within the power source unit 101. This power meter 102 functions as a first obtaining unit that obtains information of electric power input to the heater 35.

Next, the operations of the parts within the fixing device during printing operations will be described with reference to FIG. 2. The pressing roller 32 is rotationally driving in the clockwise direction by a motor (driving unit) M1 as indicated by the arrow. Frictional force at the nip portion between the pressing roller 32 and the outer face of the film 33 due to the rotational driving of the pressing roller 32 causes rotational force to act on the film 33. Accordingly, the film 33 rotates around the guide member 34 in the counter-clockwise direction as indicated by the arrow, while the inner face thereof slides in close contact with the heater 35 at the nip portion (pressing roller driving system).

The film 33 rotates with a circumferential speed approximately corresponding to the circumferential speed of the pressing roller 32. In order to reduce mutual sliding frictional force between the heater 35 and the inner face of the film 33 at the nip portion, the sliding member 35*d* (FIG. 6) is disposed on the heater 35, and a lubricant such as a heat-resistant grease or the like is interposed between the sliding member 35*d* and the inner face of the film 33.

Rotation of the pressing roller 32 is started based on a print start signal, and heating of the heater 35 is also started. In a state where the heater 35 has reached a predetermined temperature, the recording material P bearing a toner image t is introduced to the nip portion with the side bearing the toner image facing toward the film 33 side. The recording material P passes through the nip portion along with the film 33, in close contact with the heater 35 across the film 33.

In the processes of passing through, heat is applied to the recording material P by the film 33 heated by the heater 35, and the toner image t is thermally fixed to the face of the y heat being applied to the recording material P. The recording material P that has passed through the nip portion is separated from the face of the film 33, and conveyed to be discharged.

The position at which the recording material P passes in the longitudinal direction of the fixing device according to the present embodiment will be described with reference to FIG. 3. In the present embodiment, the conveyance of the recording material P is performed by middle-based conveyance. That is to say, the middle portion of the recording material P in the width direction passes through the middle portion of the film 33 in the longitudinal direction, regardless of the width of the recording material P passing through the device. Line S is an imaginary line indicating a recording-material middle-passing reference line. W1 represents the passing width of the largest recording material capable of passing (maximum sheet-passing width). In the present embodiment, this maximum sheet-passing width W1 is 297 mm, which is A4 size width. An effective heating region width A is slightly larger than this maximum sheet-passing width W1. Sheet-passing width W2 is 257 mm, which is B4 size width (short-edge feed of B4), and sheet-passing width W3 is 210 mm, which is A4 size width (short-edge feed of A4).

Hereinafter, a recording material with a width corresponding to the maximum sheet-passing width W1 (first size) will be referred to as maximum-size recording material, and a recording material with a width smaller than this recording material (second size) will be referred to as small-size recording material. In the drawings, a denotes the difference in width between the maximum sheet-passing width W1 and sheet-passing width W2 ((W1−W2)/2), and b denotes the difference in width between the maximum sheet-passing width W1 and sheet-passing width W3 (W1−W3)/2). These are non-sheet-passing portions (non-sheet-passing regions) occurring when passing B4 sheets or short-edge feed of A4 sheets, which are small-size recording materials.

Middle-based conveyance is performed for the recording material in the present embodiment, so the non-sheet-passing portions a and b occur on both ends in the right and left directions for the sheet-passing widths W2 and W3. The width of these non-sheet-passing portions differ variously depending on the width of the small-size recording material being used.

In FIG. 3, the first temperature sensor TH1 is disposed to detect the heater temperature (sheet-passing portion temperature) at a region corresponding to the inner side of a smallest possible sheet-passing width (omitted from illustration). TH2 is a second temperature sensor (second temperature detecting unit non-sheet-passing portion temperature sensor) such as a thermistor or the like, and detects the temperature of a non-sheet-passing portion. The outputs thereof (signal values relating to temperature) are input to the control circuit unit 100 via an A/D converter. In the present embodiment, the temperature sensor TH2 is disposed on the inner face of the base layer of the film portion corresponding to the non-sheet-passing portion a, in elastic contact.

The temperature sensor TH2 functions as a second obtaining unit that obtains temperature information of a region at the end portion of a rotation member facing a region where the recording material of the second size does not pass at the nip portion. This temperature sensor TH2 specifically is disposed on the free end of an elastic supporting member 38 that has a form of a leaf spring and the base portion thereof fixed to the guide member 34. The temperature sensor TH2 is in elastic contact with the base layer 33*a* of the film 33 by the elasticity of the elastic supporting member 38, and detects the temperature of the film portion corresponding to the non-sheet-passing portion a. Thus, in the present embodiment, the first temperature sensor TH1 is set to detect the heater temperature in a region corresponding to the smallest sheet width, and the second temperature sensor TH2 is set to come into elastic contact with the inner face of the base layer of the film portion at the non-sheet-passing portion.

2. Blower Cooling Mechanism Unit

Figure 7:
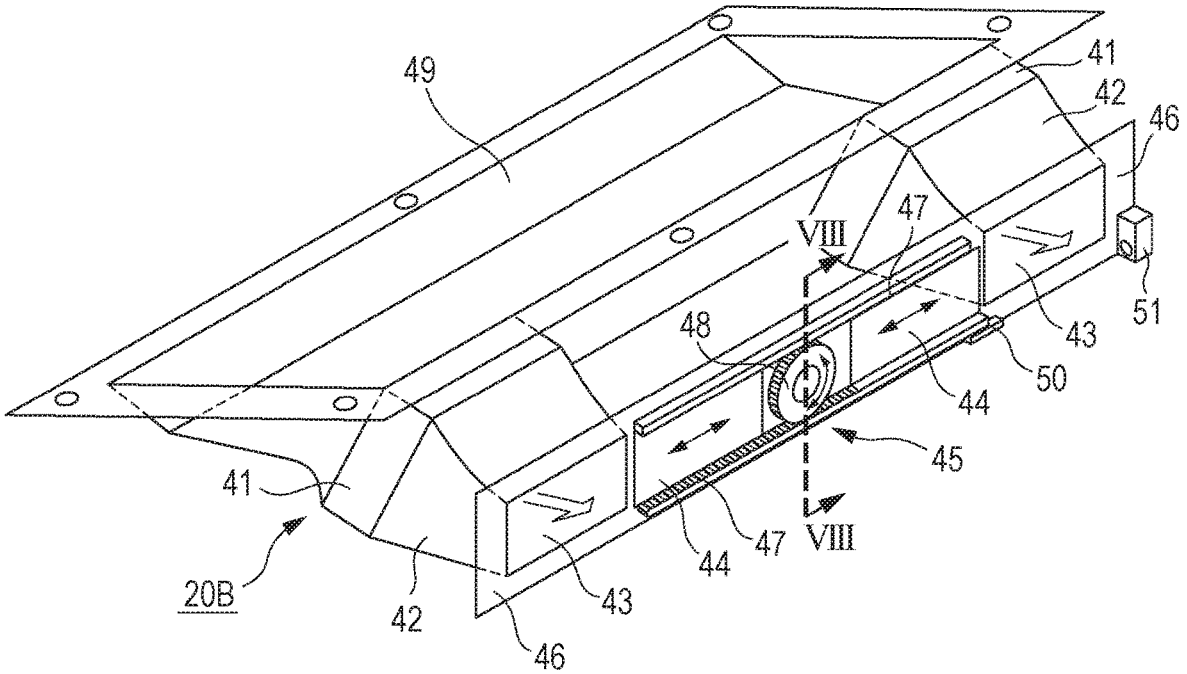
FIG. 7 is a schematic external perspective view of a blower cooling mechanism unit.
Figure 8:
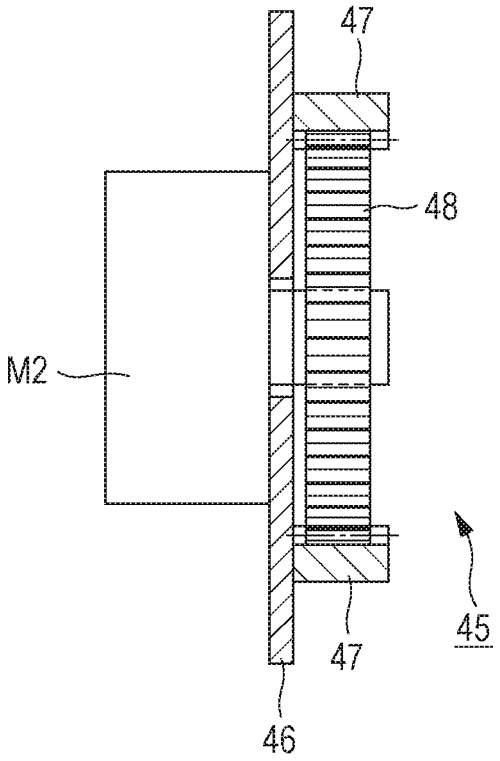
FIG. 8 is an enlarged cross-sectional view taken along VIII-VIII in FIG. 7.
Figure 9:
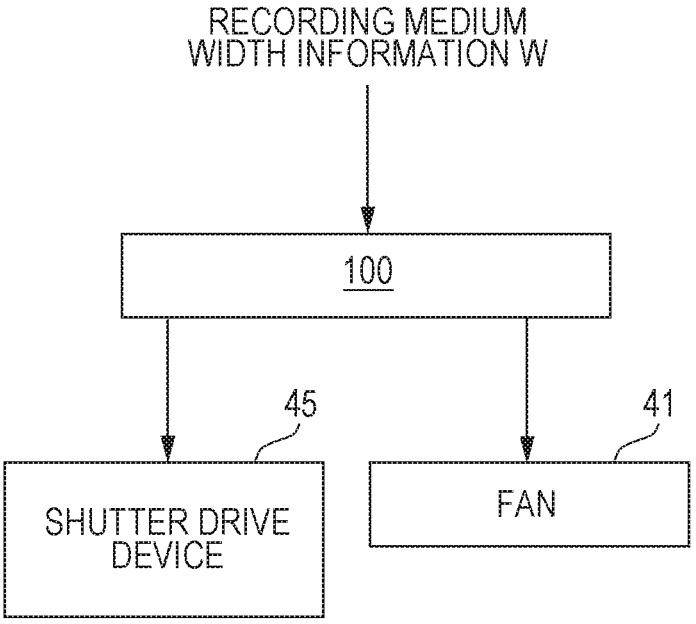
FIG. 9 is a block diagram of a control system relating to driving of a fan and shutter.

Now, in FIG. 2, the blower cooling mechanism unit 20B is a blowing unit that cools rise in temperature of the non-sheet-passing portions of the film 33 occurring due to consecutive passing of small-size recording material (small-size job) by blowing air. FIG. 7 is a schematic external perspective view of this blower cooling mechanism unit 20B. FIG. 8 is an enlarged cross-sectional view taken along VIII-VIII in FIG. 7. The blower cooling mechanism unit 20B will be described with reference to FIGS. 7 and 8.

The blower cooling mechanism unit 20B serving as the blowing unit has a cooling fan (hereinafter, "fan") 41 serving as a blowing unit, as illustrated in FIG. 7. The blower cooling mechanism unit 20B also has a wind duct (wind shielding member) 42 for guiding wind generated by the fan 41, and a blowing vent (opening) 43 disposed at the portion of the wind duct 42 facing the fixing mechanism unit 20A. The blower cooling mechanism unit 20B also has a variable opening that restricts the amount of blown air from the fan 41 (opens/closes the blowing vent 43), and has a shutter 44 that adjusts the opening width (blowing region width) to a width appropriate for the recording material that is passing, and a shutter driving device (opening width adjusting unit) 45 that drives the shutter.

In the case of middle-based conveyance, fans 41, wind ducts 42, blowing vents 43, and shutters 44, are disposed symmetrically in the longitudinal direction of the film 33. An external air intake unit 49 is disposed on the intake side of the fans 41. The axial-flow fans such as propeller fans, or centrifugal fans such as sirocco fans can be used for the fans 41, and an appropriate configuration can be selected based on necessary airflow, restrictions on installation space, and so forth. The fans 41 are used for cooling parts of the film 33 in the longitudinal direction (both edges) of which the temperature has risen, by blowing air.

The fans 41 are rotationally driven by motors M3 (omitted from illustration), to operate as the blower cooling mechanism unit 20B. Air volume (airflow) is obtained corresponding to a fan cooling level, decided by the amount of opening at the openings and the duty cycle that is the rate of operation of the fans 41 in a predetermined amount of time, which will be shown in later-described Table 2.

In FIG. 7, the left and right shutters 44 are supported to be slidable in the left and right directions, following the side face of a supporting plate 46 extending in the left and right directions, forming the blowing vents 43. The left and right shutters 44 communicate via rack teeth 47 and a pinion gear 48. The pinion gear 48 is rotated forward or backward by a motor (pulse motor) M2. Thus, the left and right shutters 44 are opened and closed together as to the corresponding blowing vents 43, in a symmetrical relation. The above-described supporting pate 46, rack teeth 47, pinion gear 48, and motor M2, make up a shutter driving device 45, as illustrated in FIG. 8.

The blowing vents 43 at the left and right are provided slightly toward the middle from the sheet-non-passing portions b that occur when small-sized sheets are passed, across to the maximum sheet-passing width W1. The left and right shutters 44 are disposed in a direction closing off the blowing vents 43 from the middle portion in the longitudinal direction of the supporting plate 46 toward the edge portions by a predetermined amount.

Now, the opening operations of the shutters 44 during printing operations will be described. Sheet recording material width information W is input to the control circuit unit 100 based on information such as user input of the width-direction size of the recording material to be used, recording material width automatic detection mechanisms (omitted from illustration) of the cassette feed units 13 and manual feed tray 17, and so forth. The control circuit unit 100 controls the shutter driving device 45 based on this information. That is to say, the blowing vents 43 can be opened by a predetermined amount A (omitted from illustration) by driving the motor M2 described in FIG. 8 above to rotate the pinion gear 48 and move the shutters 44 by the rack teeth 47.

Figure 10:
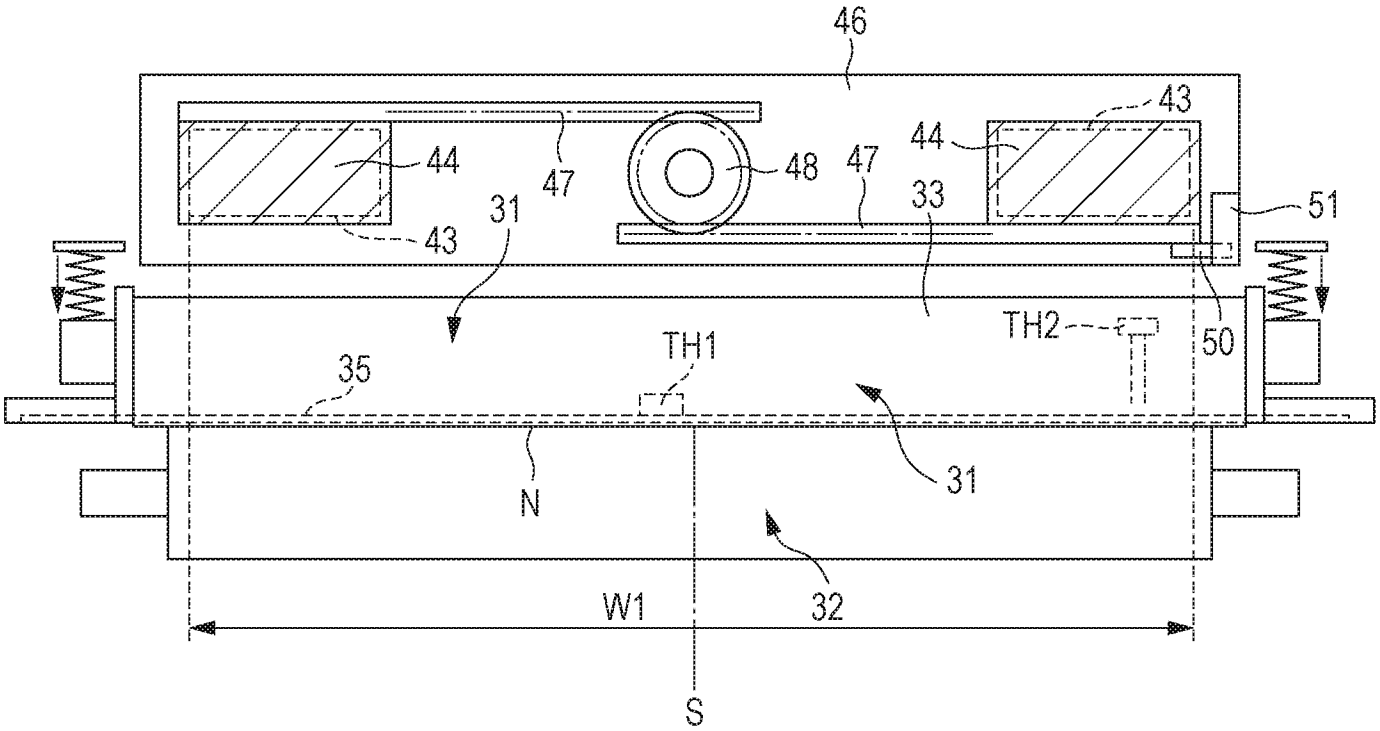
FIG. 10 is a diagram illustrating a state where the shutter has moved to a fully-closed state and has closed off a blowing vent.
Figure 11:
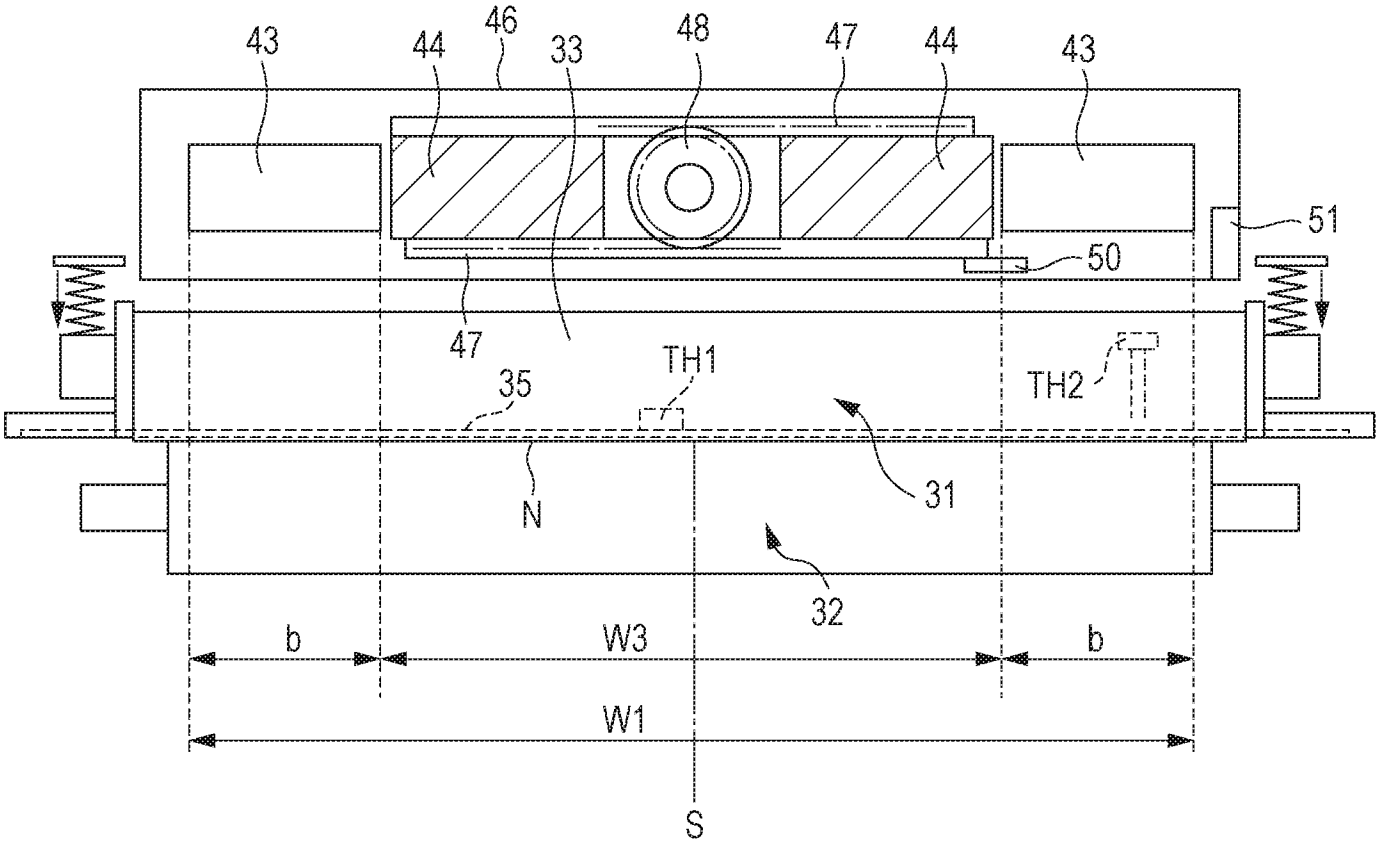
FIG. 11 is a diagram illustrating a state where the shutter has moved to a fully-opened state and has opened up the blowing vent.

When the width information of the recording material is a large-size recording material, that is A4 size wide, the control circuit unit 100 controls the shutter driving device 45 so that the shutters 44 move to a fully-dosed position where the blowing vents 43 are closed by the shutters 44, as illustrated in FIG. 10. In a case where the recording material is a small-size recording material that is A4 size short-edge feed, the shutters 44 move to a position where a portion of the blowing vents 43 corresponding to the non-sheet-passing portions b are opened, as illustrated in FIG. 11. In a case where the recording material is a small-size recording material that is B4 size width, the shutters 44 move to a position where a portion of the blowing vents 43 corresponding to the non-sheet-passing portions a are opened (FIG. 4).

Note that in a case where the small-size recording material is between the maximum sheet-passing width W1 and the minimum sheet-passing width W3, such as letter size sheets (regardless of whether long-side feed or short-side feed), the control circuit unit 100 moves the shutters 44 to positions where the blowing vents 43 are opened by amounts corresponding to the non-sheet-passing portions occurring thereby. That is to say, the shutters 44 are capable of adjusting the opening widths (blowing widths) of the blowing vents 43 in accordance with the width of the recording material. Note that the minimum, maximum, and full-sheet size in the present embodiment refer to standard size sheets that the image forming apparatus main unit guarantees, and does not refer to non-standard size sheets that a user might use on his/her own.

In FIG. 7, positional information of the shutters 44 is detected by a sensor 51 disposed on the supporting plate 46 detecting a flag 50 disposed on a predetermined position of a shutter 44. Specifically, a shutter position where the blowing vent 43 is fully closed is the home position, and the amount of opening is detected from the rotational amount of the motor M2, as illustrated in FIG. 10.

Operations when Temperature Rises at Non-Sheet-Passing Portion

Figure 12:
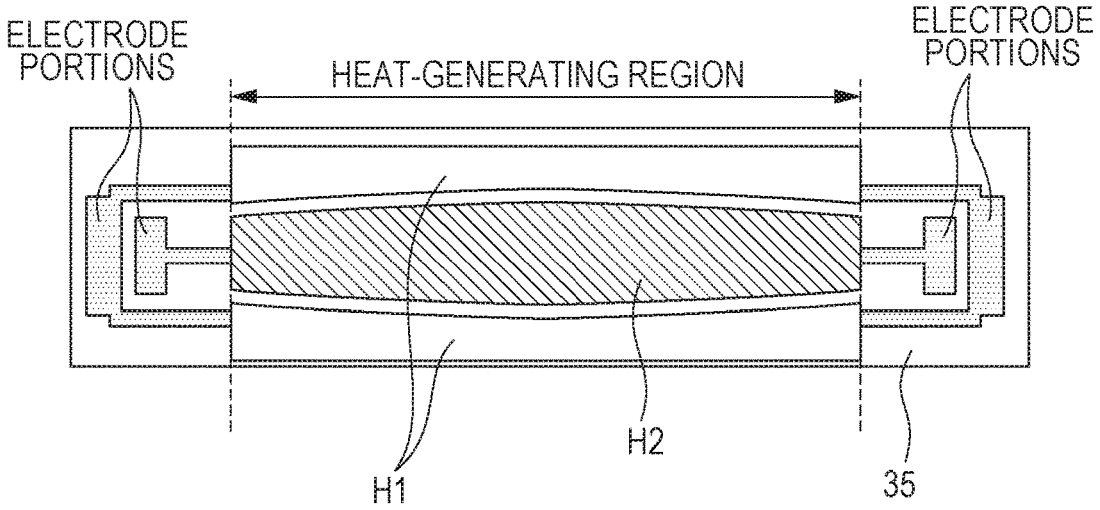
FIG. 12 is a schematic diagram illustrating the shape of a heat generator of a heater according to the first embodiment, and electrodes.

1. Suppressing Rise of Temperature at Non-Sheet-Passing Portion by Changing Configuration of Heating Elements and Thermal Distribution (Changing Electricity Application Ratio) of Heaters FIG. 12 illustrates the shapes of heating elements H1 that are first heat generating resistors and a heating element H2 that is a second heat generating resistor, arrayed in the conveyance direction of the recording material in the heater 35, and electrode portions for applying electricity to the heating elements. The heating elements H1 in the heater 35 are a main heater, and the heating element H2 is a sub-heater. The heating elements H1 that are the main heater are narrower at the middle portion in the longitudinal direction of the heater and the end portions are wide, with the width of the heating elements gradually changing therebetween.

Accordingly, the resistance value distribution of the heating elements H1 is such that the resistance value is highest at the middle portion, and gradually grows lower toward the ends. On the other hand, the heating element H2 has a shape that is opposite to that of the heating elements H1, with the middle portion in the longitudinal direction being wide, and the end portions being narrow. Accordingly, the resistance value distribution of the heating element H2 is such that the resistance value is lowest at the middle portion, and gradually grows higher toward the ends.

Figure 13:
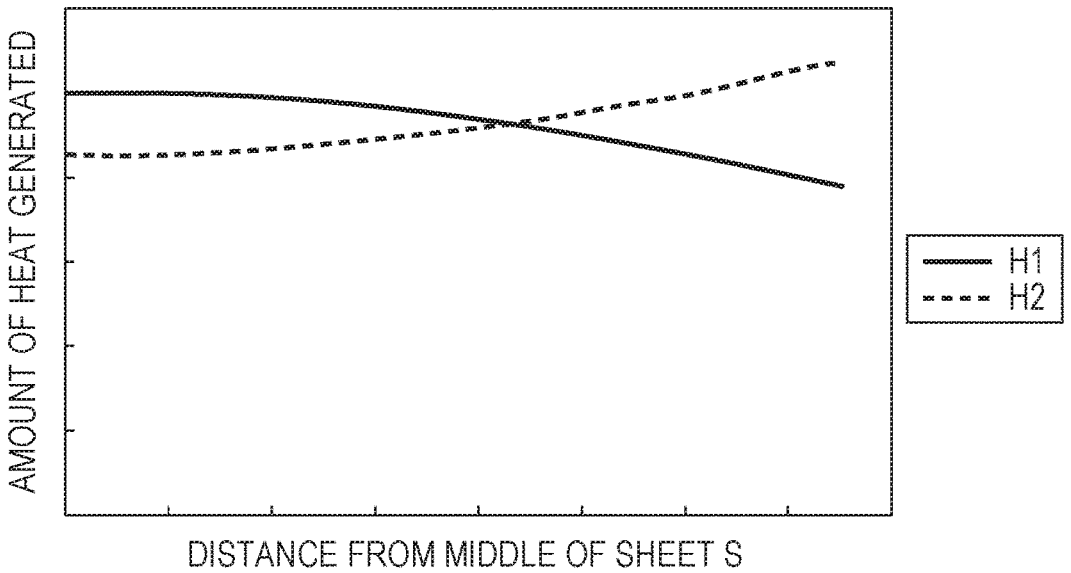
FIG. 13 is a thermal distribution diagram of heat generators in the first embodiment.

FIG. 13 illustrates a thermal distribution in the longitudinal direction at one side only, with the middle of sheets S as a reference, when applying electricity to each of the heating elements H1 and H2. The amount of heat generated is great at the middle in the longitudinal direction for the heating elements H1, while the amount of heat generated decreases toward the ends (the amount of heat generated is smaller at the ends as compared to the middle in the longitudinal direction). In the other hand, the amount of heat generated is small at the middle in the longitudinal direction for the heating element H2, while the amount of heat generated increases toward the ends (the amount of heat generated is great at the ends as compared to the middle in the longitudinal direction). The shapes of the heating elements have been designed such that when electricity is equally applied to the two heating elements, the thermal generation distribution is uniform.

Figure 14:
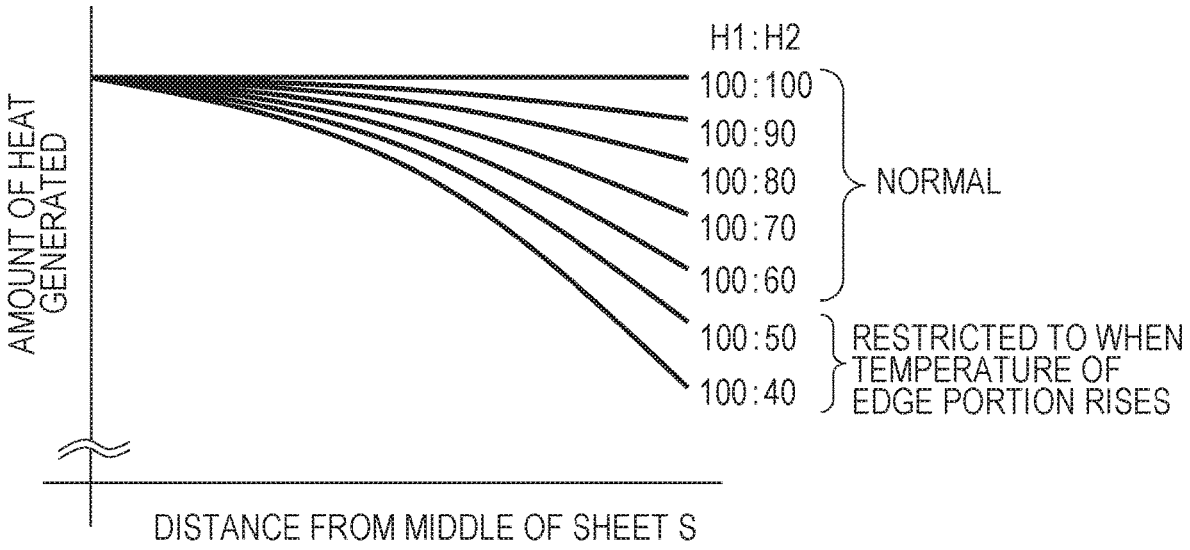
FIG. 14 is a thermal distribution diagram by electric power application ratio in the first embodiment.

FIG. 14 illustrates thermal generation distribution in a case where the amount of heat generation at the middle is made to be the same, and the electricity application ratio that is the ratio of the amount of electricity applied to the heating element H2 as to the amount of electricity applied to the heating elements H1 is changed. That is to say, the amount of electricity applied to the heating element H2 is reduced with the amount of electricity applied to the heating elements H1 at 100%, which enables the thermal generation distribution of the heater 35 in the longitudinal direction to be controlled (changed) as illustrated in FIG. 14.

FIG. 14 shows, as the ratio of the amount of electricity applied to the heating elements H1 as to the amount of electricity applied to the heating element H2, 100:100, 100:90, 100:80, 100:70, and 100:60 for normal situations, and 100:50 and 100:40 for ratios restricted to when the temperature of the edge portion rises. How to set the electricity application ratios is decided by deciding the basic width of the recording material when in a normal situation as mentioned above, studying the fixability at the edges and effects on temperature rising at non-sheet-passing portion, for each recording material width, and compiling the results thereof in an electricity application ratio table. Table 1 shows an electricity application ratio table for long-side feeding of letter size sheets (recording material width of 279.4 mm).

TABLE 1

| Electricity application ratio level | Electricity application ratio H1 (%) | Electricity application ratio H2 (%) | Electric power threshold value (%) | Temperature threshold value (° C.) |
|---|---|---|---|---|
| Level 1 | 100 | 100 | — | — |
| Level 2 | 100 | 90 | 95 | — |
| Level 3 | 100 | 80 | 90 | — |
| Level 4 | 100 | 70 | 87 | — |
| Level 5 | 100 | 60 | 83 | — |
| Level 6 | 100 | 50 | 79 | 240 |
| Level 7 | 100 | 40 | 75 | 240 |

In Table 1, electricity application ratio levels 1 through 5 correspond to the normal situation shown in FIG. 14, and the electricity application ratio is reduced below the initial value (100/100=1in Level 1) in accordance to output when having detected power consumption (power applied to heater), which is a first mode. The higher the electricity application ratio level is, the smaller H2/H1 that is the ratio of electricity application (electricity application ratio) of H1 (%) as to H2 (%).

The electric power threshold value for each level in Table 1 indicates the minimally necessary amount of electric power (electric power applied to the heater) to guarantee fixability at each of the levels. The electricity application ratio level is raised when the electric power during sheet passage falls below this threshold value. The electric power threshold value is set as a percentage of electric power as to the electric power when starting printing as 100%, for each level.

The electricity application ratio levels 6 and 7 in Table 1 correspond to a situation restricted to when temperature of the edge portions rise, as illustrated in FIG. 14. The electricity application ratio is set lower than the final value in the first mode (Level 5) in accordance with the output when detecting power consumption (electric power applied to the heater) and the output of the temperature sensor TH2 provided corresponding to the non-sheet-passing portion, which is a second mode.

The temperature threshold value for Levels 6 and 7 in Table 1 indicates the necessary upper limit temperature to guarantee fixability at each of these levels. In the second mode, in a case where the electric power detected by the power meter falls below the electric power threshold value 83% in Level 5 and the temperature detected by the temperature sensor TH2 exceeds a certain temperature threshold value set beforehand (240° C. here), the electricity application ratio level is raised as follows. That is to say, the electricity application ratio level is raised from Level 5 to Level 6, Further, in a case where the electric power detected by the power meter falls below the electric power threshold value 79% in Level 6 and the temperature detected by the temperature sensor TH2 exceeds 240° C., the electricity application ratio level is raised from Level 6 to Level 7. Thus, rise in temperature at the non-sheet-passing portions can be suppressed in the second mode by reducing the electricity application ratio for electric power applied to the heating element H2 when temperature rise is occurring at the non-sheet-passing portions, as compared to a normal situation (the electricity application ratio is minimized).

Thus, according to the first mode and second mode, the electricity application ratio of the heater is controlled without controlling the blower unit (without using the blower unit). Accordingly, consumption of electric power for cooling in the following third mode where the blower unit is used, can be suppressed. In the third mode, the blower unit is activated without controlling the electricity application ratio of the heater (without changing the electricity application ratio).

Thus, during printing operations, in the first mode, the electricity application ratio for the amount of electricity applied to the heating elements H1 and H2 is decided using the electricity application ratio table set beforehand, based on the recording material width W and the electric power necessary for when passing sheets. Further, in the second mode following the first mode, the electricity application ratio for the amount of electricity applied to the heating elements H1 and H2 is decided using the electricity application ratio table set beforehand, based on the recording material width W, the electric power necessary for when passing sheets, and the temperature at the non-sheet-passing portions.

The operations of electricity application ratio control when printing can be restated as follows regarding the first mode and the second mode. When starting printing, the electricity application ratio is always set to Level 1. This is because there is the need to uniformly warm the nip portion when starting printing to stabilizing rotation of the film 33, and to eliminate temperature unevenness in the longitudinal direction.

Thereafter, as printing operations are continuously performed, the fixing device (primarily the pressing roller) is warmed, and the amount of electric power necessary when passing sheets decreases. As the amount of electric power necessary for passing sheets falls below the electric power threshold value in each level, the electricity application ratio level is raised, and the ratio of the amount of electricity applied to the heating elements H1 as to the amount of electricity applied to the heating element H2. (electricity application ratio) is lowered (made smaller), thereby suppressing the amount of heat generated at the ends. Thus, the amount of heat generated at the non-sheet-passing portions is reduced, and temperature rise at the non-sheet-passing portions can be suppressed.

Now, in a case where sufficient electric power is being supplied to the fixing device, the electricity application ratio level jumps from Level 1 to Level 5. In electricity application ratio Level 5, electric power application is heating elements H1: heating element H2=100:60.

This electricity application ratio is an electricity application ratio optimal for printing letter size sheets in a case where sufficient power is being supplied to the configuration of the heater 35 according to the present embodiment. Accordingly, in a normal situation, the level quickly transitions to Level 5 after starting printing.

The electricity application ratio levels 2 through 4 in between are levels to be transitioned to in a case where the amount of electric power being supplied is small, and are for a mode where ensuring fixability is given priority when electric power is low, to which transition normally is not performed. Accordingly, the electricity application ratio levels 2 through 4 perform control where productivity is reduced as necessary as a measure for temperature rise at non-sheet-passing portions.

With regard to electricity application ratio levels 6 and 7, it has been confirmed that there is no problem with fixability at the edge portions of the recording material even if the electricity application ratio to the heating element H2 is reduced to lower than normal (FIG. 14). It is conceivable that this is due to heat flowing in from the outer side portions (end portions) of the fixing member from the recording material, where the temperature is higher than normal due to temperature rising at the non-sheet-passing portion.

2. Cooling Non-Sheet-Passing Portions

Next, cooling of the blower cooling mechanism unit serving as the blower unit that cools the non-sheet-passing portions by blowing (third mode) will be described. Control of the blower cooling mechanism unit 20B is performed using the output of the temperature sensor TH2 provided at the non-sheet-passing portion, as described above. In a case where the temperature of the temperature sensor TH2 exceeds a temperature threshold value that has been set beforehand, the shutters 44 are operated by the shutter driving device 45, the openings are set to an optional opening amount, and the fans are operated. Specific operations of the blower cooling mechanism unit 20B when performing long-side feeding of letter size sheets are illustrated as an end-cooling fan operation table in the following Table 2.

TABLE 2

| Fan cooling level | Cooling operations: Amount of opening (mm) | Cooling operations: Duty cycle (%) | Temperature threshold value (° C.) |
|---|---|---|---|
| Level 1 | 0 | 0 | — |
| Level 2 | 1.2 | 25 | 240 |
| Level 3 | 2.5 | 25 | 240 |
| Level 4 | 5 | 50 | 240 |
| Level 5 | 7.5 | 75 | 240 |
| Level 6 | 10 | 100 | 240 |
| Level 7 | 12 | 100 | 240 |

The operations of the blower cooling mechanism unit 20B are decided by the amount of opening of the opening portion, and the duty cycle that is the rate of operation of the fans in a predetermined amount of time. Settings have been decided for each level as shown in Table 2, and basically the higher the fan cooling level is, the more the amount of opening and the duty cycle increase, and the more powerfully the non-sheet-passing portions are cooled.

The fan cooling level is initially set to Level 1, and each time the temperature measured at the temperature sensor TH2 exceeds the temperature threshold value (240° C.) here, the fan cooling level is raised by 1. At the point that the temperature of the temperature sensor TH2 ceases to rise, the fan cooling level is maintained.

Figure 17:
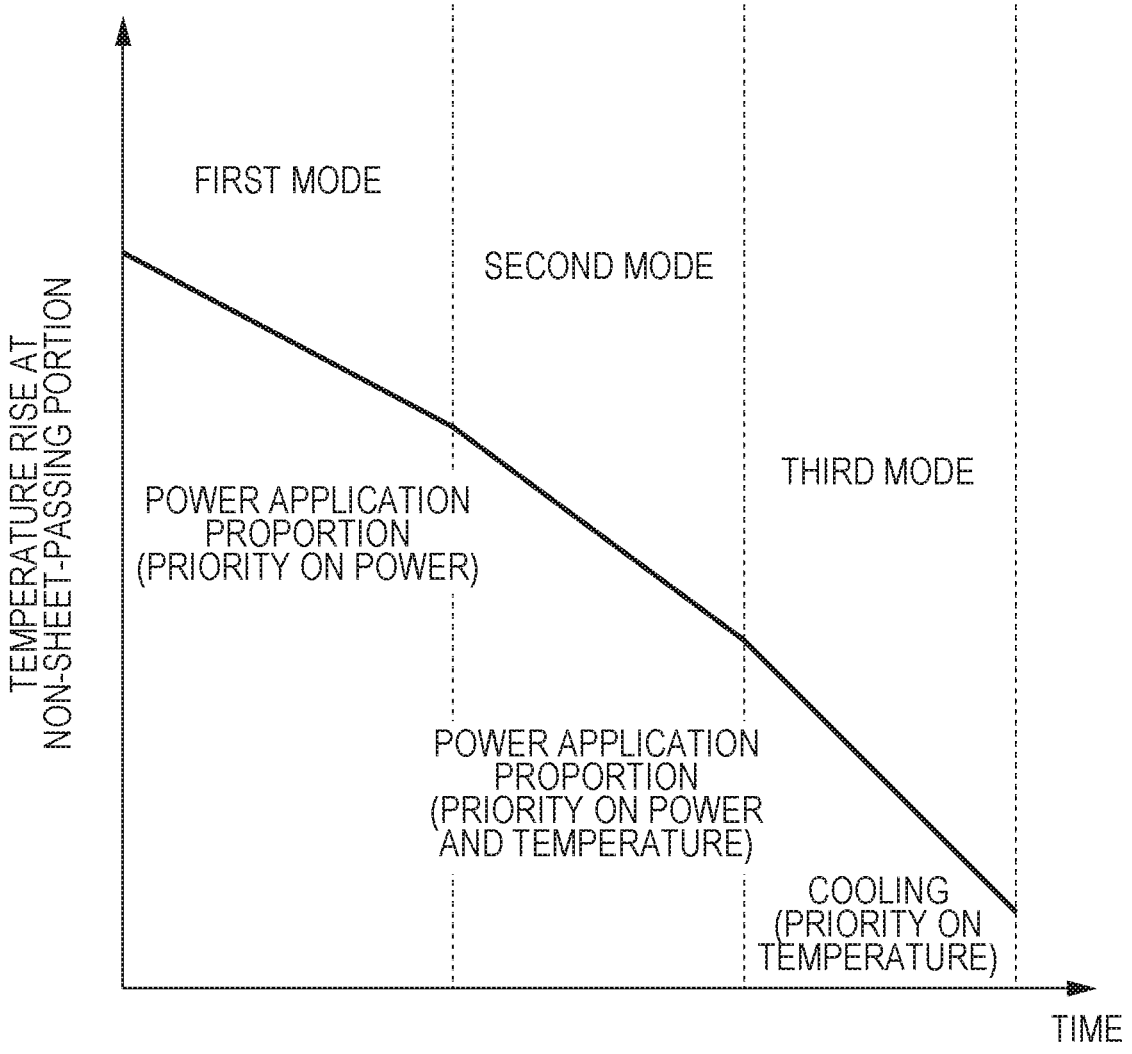
FIG. 17 is a diagram illustrating change over time of temperature rise at non-sheet-passing portions in first through third modes, according to the second embodiment.

Note that the temperature threshold value for electricity application ratio control and the temperature threshold value for operation control of the cooling mechanism are both 240° C. the reason is that restrictions are provided for control such that after the electricity application ratio reaches Level 7, the cooling mechanism starts operation with the electricity application ratio Level 7 maintained. Accordingly, the control circuit unit 100 controls in the order of the first mode, second mode, and third mode, as follows (FIG. 17), as control to counter rise in temperature at the non-sheet-passing portions.

First mode: the electricity application ratio of the amount of electric power supplied to the heating elements H1 and H2 of the heater 35 is decided by electric power consumption detected while passing sheets (amount of electric power applied to heater).

Second mode: in addition to electric power consumption detected while passing sheets (amount of electric power applied to heater), the electricity application ratio of the amount of electric power supplied to the heating elements H1 and H2 of the heater 35 is also decided by the temperature detected by the temperature sensor TH2 provided at a non-sheet-passing portion of the fixing member.

Third mode: the cooling mechanism is operated in accordance with the temperature detected by the temperature sensor TH2 provided at a non-sheet-passing portion of the fixing member.

According to the above configuration, the amount of electric power consumed by the fixing device (amount of electric power applied to the heater) was reduced as compared to a conventional example, and suppression of temperature rise at non-sheet-passing portion was performable more efficiently. The following Table 3 illustrates a comparison between the configuration according to the present embodiment and the configuration of a comparative example in a situation where letter size recording material sheets were consecutively passed, and temperature rise occurred at the non-sheet-passing portions.

TABLE 3

| | Configuration of present embodiment | Configuration of comparative example |
|---|---|---|
| Electricity application ratio | H1:H2 = 100:40 | H1:H2 = 100:60 |
| Fan operation | Cooling Level 5 | Cooling Level 7 |
| Electric power | 604 W | 668 W |

Sheet-passing conditions
- Grammage of sheets: 90 g
- Size of sheets: letter size
- Environment: Room temperature 23° C., humidity 50%
- Sheet-passing: 500 sheets consecutive, long-side feed, 55 pages per minute (ppm)

It was found that the configuration according to the present embodiment showed reduction on electric power consumption by 10% as compared to the configuration according to the comparative example, due to the amount of electric power applied to the heating element H2 being minimized and the cooling level remaining low.

Note that in the present embodiment, restrictions have been provided for control regarding a method where an order of priority is given regarding the configurations to deal with temperature rise at non-sheet-passing portions, without any difference between the temperature threshold value for electricity application ratio control and the temperature threshold value for the blower cooling mechanism. However, an arrangement may be made wherein a difference is provided between the temperature threshold value for electricity application ratio control and the temperature threshold value for the blower cooling mechanism, and an order in priority is set regarding operations thereof. Various methods can be conceived besides these, such as methods where multiple temperature sensors are provided for electricity application ratio control and the blower cooling mechanism, and so forth.

Providing a difference between the temperature threshold value for electricity application ratio control and the temperature threshold value for the blower cooling mechanism, and setting an order in priority regarding operations thereof, has the following advantages. That is to say, in a case where sudden rise in temperature has been detected with the order in priority being set for each state, cooling operations by the end cooling mechanism using blowing that can quickly lower temperature can be actuated as emergency measures.

In the present embodiment, the electric power consumption during sheet passing is directly measured during electricity application ratio control for the heater, and the electricity application ratio of application to the heating elements H1 and H2 is decided using this as a reference. However, a substitution may be made for obtaining electric power consumption wherein calculation is made from software control parameters or the like instead of directly obtaining electric power, besides this method of measuring electric power actually applied to the heating elements. That is to say, electric power being applied to the heater may be obtained from variables in electric power control.

Also, control operations for temperature rise at non-sheet-passing portions that are optimal for various conditions can be realized by setting the temperature threshold value for electricity application ratio control and the blower cooling mechanism for various fixing conditions (i.e., target temperature and conveyance speed of recording material) and sheet sizes.

Second Embodiment

Figure 15:
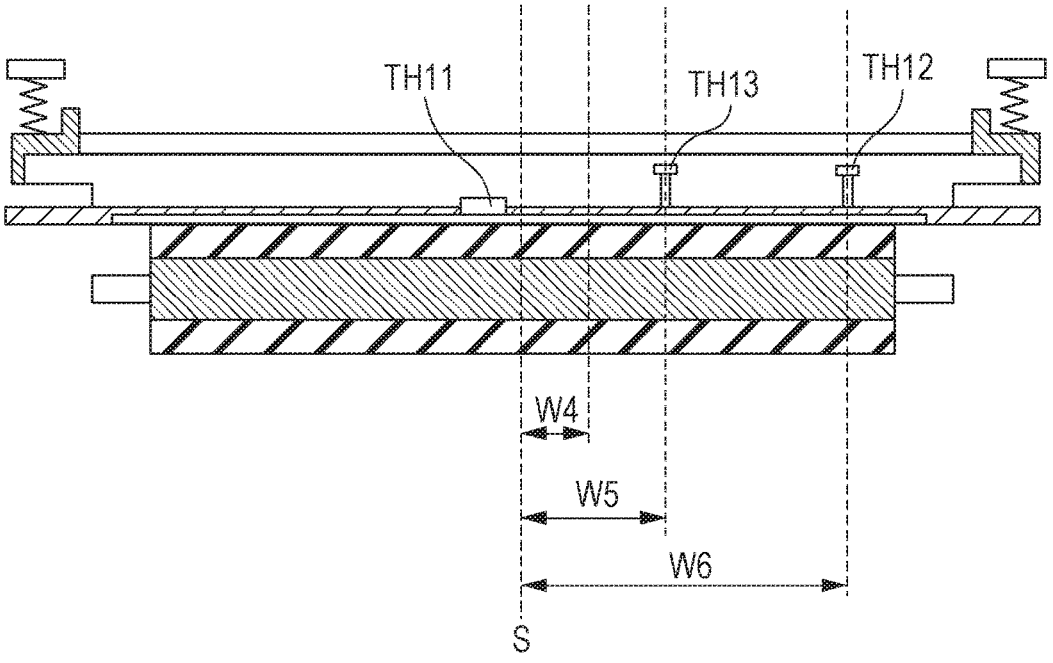
FIG. 15 is a schematic cross-sectional view of a fixing device according to a second embodiment.

In a second embodiment, providing multiple temperature detection sensors that detect the temperature of non-sheet-passing portions at different positions in the longitudinal direction of the film (inner face) serving as a fixing member is a feature. FIG. 15 is a schematic longitudinal-section view of the fixing device according to the present embodiment. The configuration of the image forming apparatus is the same as that in the first embodiment, so details thereof will be omitted. Further, the configurations of other portions of the fixing device in the present embodiment are the same as in the first embodiment, the heater has multiple heating elements with different thermal generation distributions, and also has a cooling mechanism for the fixing device. Moreover, the configuration for dealing with temperature rise at the non-sheet-passing portions include the three of electricity application ratio control by electric power consumption, electricity application ratio control by non-sheet-passing portion temperature sensor, and blower cooling mechanism, the same as with the first embodiment.

Next, the temperature detecting sensor in the present embodiment will be described. A temperature sensor TH11 is a temperature detecting sensor for temperature control to control the temperature of the fixing device, situated near the middle of where sheets pass in the fixing device, on the inner side of the smallest sheet width. TH12 and TH13 are temperature detecting sensors for detecting temperature of non-sheet-passing portions (second temperature detecting sensors) in the present embodiment, with TH12 in particular being a non-sheet-passing portion temperature detecting sensor for printing large-size sheets, and TH13 being a temperature detecting sensor effective for when printing small-size sheets.

An example will be described regarding temperature rise at non-sheet-passing portions with letter size as large-size sheets, and Comm. #10 size sheets (104.7×241.3 mm) as small-size sheets. In FIG. 15, W4 is the sheet edge position (52.35 mm (i.e., (104.7 mm/2)) when passing Comm. #10 size sheets and W5 is a position (74.0 mm) from the center of sheet passing for the temperature detecting sensor TH13 for non-sheet-passing portions during small-size printing. W6 is a position (151.0 mm) from the center of sheet passing for the temperature detecting sensor TH12 for non-sheet-passing portions during large-size printing.

Figure 16A:
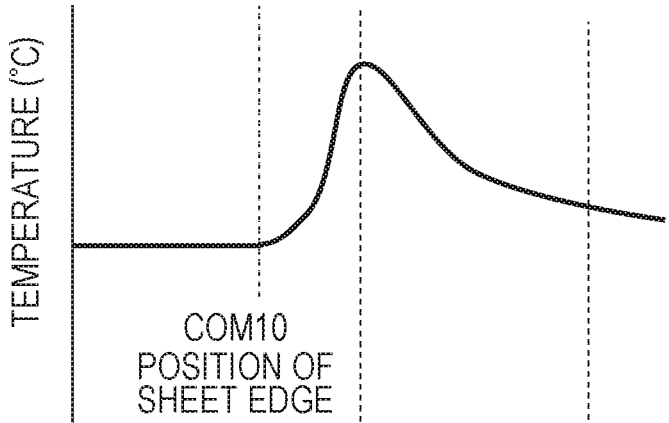
FIGS. 16A and 16B are temperature distributions when passing Comm. #10 size sheets and letter size sheets, respectively.
Figure 16B:
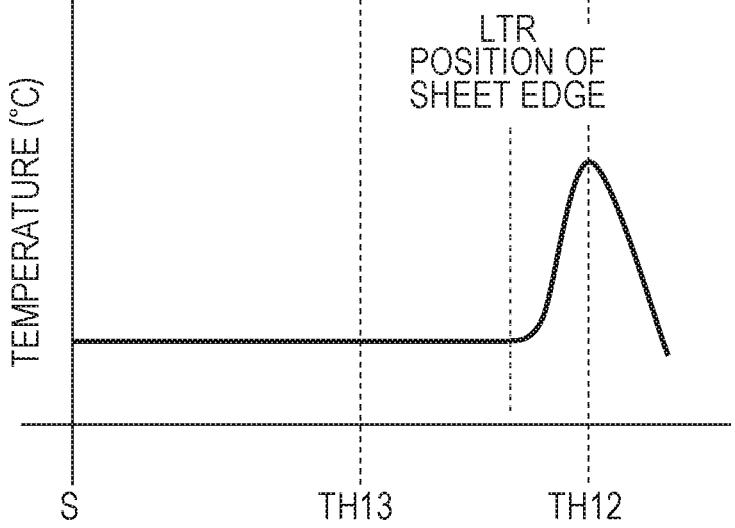

FIGS. 16A and 16B illustrate the way in which temperature rises at non-sheet-passing portions when letter size sheets are consecutively passed (FIG. 16B) as compared to way in which temperature rises at non-sheet-passing portions when Comm. #10 size sheets are consecutively passed (FIG. 16A). When letter size sheets are passed (FIG. 16B), non-sheet-passing portion temperature rising regions are generated around the ends of the fixing device in the longitudinal direction, so the temperature of the non-sheet-passing portions can be accurately measured by the temperature detecting sensor TH12 situated for when printing large-size sheets.

Based on the temperature detection results, temperature rise of non-sheet-passing portions is first controlled by controlling thermal generation distribution (electricity application ratio) of the heater, and further the rise in temperature at the non-sheet-passing portions is suppressed by blowing air when rise in temperature at the non-sheet-passing portion cannot be suppressed, the same as in the first embodiment. Accordingly, temperature rise at non-sheet-passing portions can be efficiently suppressed in the same way as in the first embodiment, and waste of electric power consumption can be minimized.

On the other hand, the region where rise of temperature in non-sheet-passing portions occurs when passing Comm. #10 size sheets differs from when passing letter size sheets, since the sheets are narrower, and the temperature distribution is such as illustrated in FIG. 16A. The reason why this temperature distribution occurs is because the amount of electric power applied to the heating element H2 of the heater 35 is reduced in the range where the thermal generation distribution of the heater is set based on the sheet size and electric power consumption, and the thermal generation distribution reflects the smaller amount of heat generated at the heater in the fixing unit.

In a case of performing electricity application ratio control by the temperature detected at the non-sheet-passing portion temperature detecting sensor TH12 in this state, the position of the temperature detecting sensor TH12 is far from the sheet passing portion and the rise in temperature is gradual, so the state of temperature rise at the non-sheet-passing portion is not readily detected with accuracy. Even such situations can be handled by using methods of changing threshold value temperature in accordance with sheet size, and methods of comprehending the transition of temperature rise at non-sheet-passing portions beforehand and deciding conditions for sheet passing (electricity application ratio, operations of the blower cooling mechanism, etc.). However, each of these methods requires the need to set many margins in specifications (e.g., threshold value temperature, etc.) when taking erroneous detection due to detection error and so forth into consideration, consequently sacrificing user convenience.

Accordingly, the dedicated temperature detecting sensor TH13 is set for detecting temperature rise in non-sheet-passing portions for small-size sheets such as Comm. #10 size sheets. The temperature detecting sensor TH13 is set at a position 74 mm form the center of sheet passage, and accordingly is particularly effective regarding temperature rise at non-sheet-passing portions occurring when sheets that are 148 mm (i.e., 74 mm×2) or smaller pass.

The region where rise in temperature at non-sheet-passing portions is near to the temperature detecting sensor TH13, so the way in when temperature rises can be comprehended in detail by the temperature detecting sensor TH13. Accordingly, using the detection results of the temperature detecting sensor TH13 to perform electricity application ratio control of the heater 35 and operation control of the blower cooling mechanism enables temperature rise at non-sheet-passing portions to be accurately dealt with. The electricity application ratio for the heating elements, the amount of opening for the fan openings, and so forth, are set to the settings made for Comm. #10 size sheets beforehand.

The following Table 4 and Table 5 are tables for electricity application ratio control and end cooling fan operations when passing Comm. #10 size sheets. The values for temperature threshold values differ between the configuration according to the present embodiment and a configuration of a comparative example in both Tables 4 and 5. The difference in temperature threshold values is due to the position in the longitudinal direction of the temperature detecting sensor used for the control. In the configuration of the comparative example, the temperature detecting sensor TH12, which is at a position far from the portion where temperature rises due to temperature rise at non-sheet-passing portions when Comm. #10 size sheets are passed, and thus temperature does not readily rise, is used for control, so the temperature threshold value needs to be set low.

In a case where the temperature threshold value is low and the temperature difference as to the sheet passing region is small, the probability of erroneous detection is higher. For example, in a case where Comm. #10 size sheets are printed immediately after a previous print job, there is a possibility that the temperature at the position of the temperature detecting sensor TH12 will be high due to heat remaining from the previous print job, and erroneous detection will be made that heat rise is occurring at the non-sheet-passing portions, even though no rise in temperature is actually occurring at the non-sheet-passing portions.

On the other hand, the configuration according to the present embodiment performs control using the temperature detecting sensor TH13. As described earlier, the temperature detecting sensor TH13 is near to the portion of temperature rise at non-sheet-passing portions occurring when passing Comm. #10 size sheets, so the temperature threshold value can be set higher. The temperature threshold value is high and difference in temperature as to the sheet passing region can be clearly differentiated, so the probability of erroneous detection is extremely low even in a state where the temperature of the entire fixing device is high immediately after printing.

TABLE 4

| Electricity application ratio level | Electricity application ratio H1 (%) | Electricity application ratio H2 (%) | Electric power threshold value (%) | Temperature threshold value (° C.) Configuration of present embodiment | Temperature threshold value (° C.) Configuration of comparative example |
|---|---|---|---|---|---|
| Level 1 | 100 | 100 | — | — | — |
| Level 2 | 100 | 90 | 95 | — | — |
| Level 3 | 100 | 80 | 90 | — | — |
| Level 4 | 100 | 60 | 87 | — | — |
| Level 5 | 100 | 40 | 83 | — | — |
| Level 6 | 100 | 20 | 79 | 240 | 150 |
| Level 7 | 100 | 0 | 75 | 240 | 150 |

TABLE 5

| Fan cooling level | Cooling operations Amount of opening (mm) | Cooling operations Duty cycle (%) | Temperature threshold value (° C.) Configuration of present embodiment | Temperature threshold value (° C.) Configuration of comparative example |
|---|---|---|---|---|
| Level 1 | 0 | 0 | — | — |
| Level 2 | 50 | 25 | 240 | 150 |
| Level 3 | 60 | 25 | 240 | 150 |
| Level 4 | 70 | 50 | 240 | 150 |
| Level 5 | 80 | 75 | 240 | 150 |
| Level 6 | 90 | 100 | 240 | 150 |
| Level 7 | 100 | 100 | 240 | 150 |

Thus, placing multiple temperature detecting sensors that detect temperatures of non-sheet-passing portions at different positions in the longitudinal direction of the fixing device, and changing the temperature detecting sensors used for control in accordance with the sheet size enables rise in temperature at non-sheet-passing, portions to be handled more accurate with regard to various sheet sizes.

An example of a configuration where multiple temperature detecting sensors are disposed only on one side from the center of sheet passing has been described in the present embodiment. However, there is no need for the temperature detecting sensors to only be on one side of the sheet passing center in the image forming apparatus where the reference of sheet passing is a center reference, and temperature detecting sensors may be disposed on both sides, giving consideration to convenience in installation and so forth. Although film temperature is measured for temperature detection of rise in temperature at non-sheet-passing portions in the present embodiment, temperature detecting sensors preferably are installed at locations where the effects of rise in temperature are conceivably great. Accordingly, depending on the configuration of the fixing device, there may be cases where temperature detecting sensors are disposed at the rear side of the heater, on the surface of the pressing roller, and so forth, to detect temperature of temperature rise at non-sheet-passing portions.

The electricity application ratio for the heating elements and the amount of opening of fan openings are set beforehand, for each size of the standard sheet sizes that the image forming apparatus main body guarantees as recording material. The same can be done to handle various other sheet sizes as well.

MODIFICATIONS

Although the present disclosure has been described above by way of embodiments, the present disclosure is not restricted to these embodiments, and various modifications may be made within the scope of the present disclosure.

First Modification

Description has been made in the above embodiments that the first mode, second mode, and third mode are executed by the control circuit unit 100 in that order, to suppress electric power consumption at the fixing device by minimizing temperature rise at the non-sheet-passing portions by electricity application ratio control before cooling the non-sheet-passing portions.

However, the present disclosure is not restricted to these, and the control unit may perform control as follows without executing the above-described first mode, in order to suppress electric power consumption of the fixing device by minimizing temperature rise at the non-sheet-passing portions by electricity application ratio control before cooling the non-sheet-passing portions. That is to say, in a case where the width direction of the recording material is the second size (small size), a first mode where the electricity application ratio is made to be smaller than the initial value (equivalent to the above-described second mode), and a second mode where the blower unit is operated (equivalent to the above-described third mode), in accordance with the output of the first obtaining unit, are provided. The first mode and the second mode can be executed in that order.

Second Modification

Although the second temperature sensor TH2, and TH12 and TH13 have been described as being in elastic contact with the inner face of the base layer of film opposing a region in the width direction of the nip portion where recording material of the second size (small size) does not pass in the above embodiment, the present disclosure is not restricted to this. The second temperature sensor TH2 and TH3 may be provided to come into contact with an end region of the pressing roller facing a region in the width direction of the nip portion where recording material of the second size (small size) does not pass. Alternatively, a temperature sensor may be provided to come into contact with an end region of the heater corresponding to a region in the width direction of the nip portion where recording material of the second size (small size) does not pass.

Although the first temperature sensor TH1 has been described as being in contact with the heater 35 within the minimum sheet-passing width in the above embodiment, the first temperature sensor TH1 may be disposed coming into elastic contact with the inner face of the base layer of the film.

Third Modification

The above embodiments have been described by way of an example of a fixing device using the film heating system. However, configurations may be used where a halogen heater is sued for the heater to heat film and roller, for example. Also, although a pressing roller has been described in the above embodiments as an opposing member, a rotating endless belt may be used.

Fourth Modification

Although recording paper has been described as the recording material in the above embodiments, the present disclosure is not restricted to paper for the recording material. Generally, recording material is a sheet-formed material on which a toner image is formed by the image forming apparatus, examples of which include standard or non-standard sized plain paper, heavy paper, lightweight paper, envelopes, postcards, stickers, resin sheets, overhead projector (OHP) sheets, glossy paper, and so forth. Any expression in the embodiments that would imply that the recording material (sheets) P is paper has been made for convenience of description, and it should be clearly understood that the recording material in the present disclosure is not restricted to paper.

Fifth Modification

Although a fixing device where unfixed toner images are fixed onto sheets has been described in the above embodiments, but the present disclosure is not restricted to this. The present disclosure is also applicable in the same way to devices where temporarily-fixed toner images on sheets are heated and pressed in order to improve glossiness of the image (also referred to as a fixing device in this case as well).

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority of Japanese Patent Application No. 2017-181188, filed Sep. 21, 2017, which is hereby incorporated by reference herein in its entirety.

What is claimed:

1. An image forming apparatus, comprising:

an image forming unit configured to form a toner image on a recording material;

a fixing unit configured to fix the toner image formed on the recording material onto the recording material, the fixing unit including a rotation member, an opposing member configured to form a fixing nip portion along with the rotation member to pinch and convey the recording material, and a heater configured to change thermal generation distribution in a direction orthogonal to a conveyance direction of the recording material;

a blower unit configured to suppress rise in temperature at a non-sheet-passing portion in the fixing unit where the recording material does not pass, the blower unit blowing air on at least one of the rotation member and the opposing member; and a control unit, wherein the control unit is configured to set, when performing fixing processing to fix a toner image onto the recording material, a first mode where thermal generation distribution of the heater is switched in accordance with electric power supply to the heater, a second mode where thermal generation distribution of the heater is switched in accordance with the electric power supply to the heater and temperature at the non-sheet-passing portion, and a third mode where the blower unit is driven in accordance with temperature at the non-sheet-passing portion.

2. The image forming apparatus according to claim 1, wherein, in the first mode, a ratio of the electric power supply to the heater with regard to the non-sheet-passing portion of the fixing unit, to the electric power supply to the heater with regard to a sheet-passing region of the fixing unit, is reduced as a size of the recording material is reduced.

3. The image forming apparatus according to claim 2, wherein, in the first mode, the control unit effects control such that, when the electric power supply to the heater is less than an electric power threshold value, the ratio of the electric power supply to the heater with regard to the non-sheet-passing portion of the fixing unit, to the electric power supply to the heater with regard to the sheet-passing region, where the recording material passes, of the fixing unit, is reduced.

4. The image forming apparatus according to claim 3, wherein, the lower the ratio of the electric power supply to the heater with regard to the non-sheet-passing portion of the fixing unit, to the electric power supply to the heater with regard to a sheet-passing region of the fixing unit, the lower the electric power threshold value is.

5. The image forming apparatus according to claim 3, wherein, in the first mode, in a case where the ratio of the electric power supply to the heater with regard to the non-sheet-passing portion of the fixing unit, to the electric power supply to the heater with regard to a sheet-passing region of the fixing unit, falls below a predetermined ratio, the control unit transitions from the first mode to the second mode, and continues fixing processing.

6. The image forming apparatus according to claim 5, wherein, in the second mode, in a case where the electric power supply to the heater is less than the electric power threshold value, and the temperature in the non-sheet-passing portion rises to a temperature threshold value, the control unit effects control where the ratio of the electric power supply to the heater with regard to the non-sheet-passing portion of the fixing unit, to the electric power supply to the heater with regard to a sheet-passing region of the fixing unit is reduced.

7. The image forming apparatus according to claim 6, wherein, when the ratio of the electric power supply to the heater with regard to the non-sheet-passing portion of the fixing unit, to the electric power supply to the heater with regard to a sheet-passing region of the fixing unit is at a predetermined ratio, and the temperature within the non-sheet-passing portion rises to the temperature threshold value, the control unit transitions from the second mode to the third mode and continues fixing processing.

8. The image forming apparatus according to claim 7, wherein the blower unit includes a blower fan, and a shutter configured to switch a width of an opening that is a passage region of wind from the blower fan, and wherein in the third mode, the control unit drives the shutter so that the area of the opening increases each time the temperature at the non-sheet-passing portion reaches the temperature threshold value.

9. The image forming apparatus according to claim 1, wherein the control unit does not execute blowing by the blowing unit in the first mode and in the second mode.

10. The image forming apparatus according to claim 1, wherein the heater includes a first heating element, and a second heating element of which thermal generation distribution differs from that of the first heating element, the first heating element and the second heating element being configured to generate heat independently from each other.

11. The image forming apparatus according to claim 1, wherein the fixing unit includes a temperature detection element configured to detect the temperature at the non-sheet-passing portion of the fixing unit.

12. The image forming apparatus according to claim 1, further comprising:

an electric power information obtaining unit configured to obtain information regarding the electric power supplied to the heater.

13. The image forming apparatus according to claim 1, wherein the fixing unit has a cylindrical film configured to rotate while in contact with the recording material, the heater being in contact with an inner face of the film.

14. The image forming apparatus according to claim 13, wherein the fixing unit further includes a pressing roller configured to form the fixing nip portion along with the heater, across the film.

15. An image forming apparatus, comprising:

an image forming unit configured to form a toner image on a recording material;

a fixing unit configured to fix the toner image formed on the recording material onto the recording material, the fixing unit including a rotation member, an opposing member configured to form a fixing nip portion along with the rotation member to pinch and convey the recording material, and a heater configured to change thermal generation distribution in a direction orthogonal to a conveyance direction of the recording material;

a blower unit configured to suppress rise in temperature at a non-sheet-passing portion in the fixing unit where the recording material does not pass, the blower unit blowing air on at least one of the rotation member and the opposing member; and a control unit, wherein the control unit is configured to switch, when performing fixing processing to fix a toner image onto the recording material, the thermal generation distribution of the heater when the temperature of the non-sheet-passing portion rises to a temperature threshold value, and when the temperature rises to the temperature threshold value again, driving the blower unit.

16. The image forming apparatus according to claim 15, wherein, when the temperature of the non-sheet-passing portion rises to the temperature threshold value, the control unit effects control so that the ratio of the electric power supply to the heater with regard to the non-sheet-passing portion of the fixing unit, to the electric power supply to the heater with regard to the sheet-passing region of the fixing unit, where the recording material passes, is reduced.

17. The image forming apparatus according to claim 16, wherein, when the ratio of the electric power supply to the heater with regard to the non-sheet-passing portion of the fixing unit, to the electric power supply to the heater with regard to the sheet-passing region of the fixing unit is at a predetermined ratio, and the temperature within the non-sheet-passing portion rises to the temperature threshold value again, the control unit drives the blower unit.

18. The image forming apparatus according to claim 17, wherein the blower unit includes a blower fan, and a shutter configured to switch a width of an opening that is a passage region of wind from the blower fan, and wherein the control unit drives the shutter so that the area of the opening increases each time the temperature at the non-sheet-passing portion reaches the temperature threshold value.

19. The image forming apparatus according to claim 15, wherein the fixing unit has a cylindrical film configured to rotate while in contact with the recording material, the heater being in contact with an inner face of the film.

20. The image forming apparatus according to claim 19, wherein the fixing unit further includes a pressing roller configured to form the fixing nip portion along with the heater, across the film.

* * * * *